US008695365B2

(12) United States Patent
Yazaki et al.

(10) Patent No.: US 8,695,365 B2
(45) Date of Patent: Apr. 15, 2014

(54) APPARATUS FOR MANAGING OPERATION OF FREEZING MACHINE

(75) Inventors: Kei Yazaki, Moriguchi (JP); Kyoichi Takano, Moriguchi (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 185 days.

(21) Appl. No.: 13/367,820

(22) Filed: Feb. 7, 2012

(65) Prior Publication Data

US 2012/0204582 A1 Aug. 16, 2012

Related U.S. Application Data

(63) Continuation of application No. PCT/JP2010/063378, filed on Aug. 6, 2010.

(30) Foreign Application Priority Data

Aug. 7, 2009 (JP) ..... 2009-184695
Jul. 23, 2010 (JP) ..... 2010-166186

(51) Int. Cl.
*F25D 21/00* (2006.01)
*F25B 1/00* (2006.01)
*F25B 19/00* (2006.01)
*F25B 49/00* (2006.01)

(52) U.S. Cl.
USPC ..... 62/234; 62/150; 62/230; 62/231

(58) Field of Classification Search
USPC ..... 62/150, 230, 231, 234, 24
See application file for complete search history.

(56) References Cited

U.S. PATENT DOCUMENTS

2012/0047920 A1 * 3/2012 Hanley et al. ..... 62/80

FOREIGN PATENT DOCUMENTS

JP 07305935 A * 11/1995 ..... F25D 11/00
JP 11281176 * 10/1999 ..... F25B 5/02

* cited by examiner

*Primary Examiner* — Mohammad M Ali
*Assistant Examiner* — Daniel C Comings
(74) *Attorney, Agent, or Firm* — Westerman, Hattori, Daniels & Adrian, LLP

(57) ABSTRACT

An apparatus for managing operation of refrigerating machines controls defrosting of evaporators of refrigeration cycles. Each of the refrigeration cycles uses a compressor, a condenser, a decompressor, and the evaporator, and is formed for a corresponding one of cooling/heating devices installed in a single store. The apparatus obtains a total estimated power consumption in a case of a pull-down operation using power consumptions necessary for the pull-down operation performed for the cooling/heating devices after defrosting is performed and using a power consumption of the store that includes at least the power consumptions of the refrigeration cycles and that is estimated for each of predetermined time periods. The apparatus changes defrosting start times or defrosting end times of the cooling/heating devices so that the total estimated power consumption does not exceed an upper limit value of a power consumption set in advance by the store.

16 Claims, 14 Drawing Sheets

FIG. 7

| REFRIGERATING MACHINE | DEFROSTING CYCLE C (h) | DEFROSTING PERIOD t (h) | PULL-DOWN PERIOD Pt (h) | POWER CONSUMPTION P DURING PULL-DOWN OPERATION | SHIFT DIRECTION |
|---|---|---|---|---|---|
| 12A | C1 | 0.5 | 0.5 | a | +(↑) |
| 12B | C2 | 0.5 | 0.5 | b | −(↓) |
| 12C | C3 | 0.5 | 0.5 | c | −(↓) |
| 12D | C4 | 0.5 | 0.5 | d | −(↓) |
| 12E | C5 | 0.5 | 0.5 | e | −(↓) |
| 12F | C6 | 0.5 | 0.5 | f | +(↑) |
| 12G | C7 | 0.5 | 0.5 | g | +(↑) |

FIG. 8A

| ESTIMATION TIME PERIOD T | ESTIMATED POWER CONSUMPTION A | POWER CONSUMPTION P DURING PULL-DOWN OPERATION | | | | | | | TOTAL ESTIMATED POWER CONSUMPTION AT | COMPARISON WITH CONTRACTED AMOUNT OF ELECTRIC POWER |
|---|---|---|---|---|---|---|---|---|---|---|
| | | 12A | 12B | 12C | 12D | 12E | 12F | 12G | | |
| T1 | A1 | a | | | | | | | A1 + a | — |
| T2 | A2 | | b | c | | | | g | A2 + b + c + g | EXCESS |
| T3 | A3 | | | | | e | | | A3 + e | EXCESS |
| T4 | A4 | | | | | | | | A4 | — |
| T5 | A5 | | | | d | | | | A5 + d | — |
| T6 | A6 | | | | | | f | | A6 + f | — |

FIG. 8B

| ESTIMATION TIME PERIOD T | ESTIMATED POWER CONSUMPTION A | POWER CONSUMPTION P DURING PULL-DOWN OPERATION | | | | | | | TOTAL ESTIMATED POWER CONSUMPTION AT | COMPARISON WITH CONTRACTED AMOUNT OF ELECTRIC POWER |
|---|---|---|---|---|---|---|---|---|---|---|
| | | 12A | 12B | 12C | 12D | 12E | 12F | 12G | | |
| T1 | A1 | a | | | | | | g | A1 + a + g | — |
| T2 | A2 | | b | c | | | | ↑ | A2 + b + c | — |
| T3 | A3 | | | | | ↓ | | | A3 | — |
| T4 | A4 | | | | | e | | | A4 + e | — |
| T5 | A5 | | | | d | | | | A5 + d | — |
| T6 | A6 | | | | | | f | | A6 + f | — |

FIG. 10A

| ESTIMATION TIME PERIOD T | ESTIMATED POWER CONSUMPTION A | POWER CONSUMPTION P DURING PULL-DOWN OPERATION | | | | | | | TOTAL ESTIMATED POWER CONSUMPTION AT | COMPARISON WITH CONTRACTED AMOUNT OF ELECTRIC POWER |
|---|---|---|---|---|---|---|---|---|---|---|
| | | 12A | 12B | 12C | 12D | 12E | 12F | 12G | | |
| T1 | A1 | a | | | | | | | A1 + a | — |
| T2 | A2 | | b | c | | | | g | A2 + b + c + g | EXCESS |
| T3 | A3 | | | | | e | | | A3 + e | — |
| T4 | A4 | | | | | | | | A4 | — |
| T5 | A5 | | | | d | | | | A5 + d | — |
| T6 | A6 | | | | | | f | | A6 + f | EXCESS |

FIG. 10B

| ESTIMATION TIME PERIOD T | ESTIMATED POWER CONSUMPTION A | POWER CONSUMPTION P DURING PULL-DOWN OPERATION | | | | | | | TOTAL ESTIMATED POWER CONSUMPTION AT | COMPARISON WITH CONTRACTED AMOUNT OF ELECTRIC POWER |
|---|---|---|---|---|---|---|---|---|---|---|
| | | 12A | 12B | 12C | 12D | 12E | 12F | 12G | | |
| T1 | A1 | a | | | | | | | A1 + a | — |
| T2 | A2 | | ↓ | c | | | | g | A2 + c + g | — |
| T3 | A3 | | b | | | ↓ | | | A3 + b | — |
| T4 | A4 | | | | | e | | | A4 + e | — |
| T5 | A5 | | | | ↓ | | f | | A5 + f | — |
| T6 | A6 | | | | d | | ↑ | | A6 + d | — |

APPARATUS FOR MANAGING OPERATION OF FREEZING MACHINE

BACKGROUND

1. Exemplary Field

The preferred embodiments of the present invention relate to, for example, apparatuses for managing operation of refrigerating machines. In some particular examples, the preferred embodiments relate to apparatuses for managing operation of refrigerating machines, the apparatuses controlling defrosting periods of a plurality of cooling/heating devices, such as showcases, refrigerators, freezers, or air conditioners, so as to prevent electric power from exceeding a predetermined maximum demand, the cooling/heating devices being installed in a store such as a supermarket and having refrigeration cycles formed therefor.

2. Description of the Related Art

In a store such as a supermarket, operation states of a plurality of cooling/heating devices, such as showcases or air conditioners, that are installed in the store and that have refrigeration cycles are centrally controlled by an apparatus for managing operation of refrigerating machines. Each of the refrigeration cycles is, typically, a cycle formed by connecting a compressor, a condenser, a decompressor, and an evaporator in a loop. When frost is deposited on the evaporator in a case in which a cooling operation is performed, the cooling efficiency decreases because the thermal conductivity of frost is low. In a case of an air conditioner, when the cooling operation is performed, the air conditioner is used in a state in which the evaporator thereof is at a temperature of about 15° C. Accordingly, the temperature of the evaporator of the cooling/heating device is higher than the temperature of the evaporator of a refrigerating apparatus or a freezing apparatus, and the frequency of deposition of frost is low. However, when a heating operation is performed, the air conditioner may be used in a state in which the evaporator thereof is at a temperature of 0° C. or lower. Accordingly, frost may be deposited on the evaporator.

In the related art, in a case of defrosting a plurality of cooling/heating devices, the cooling/heating devices are grouped into groups, and a time at which defrosting is performed is controlled for each of the groups (for example, see Japanese Unexamined Patent Application Publication No. 2008-111625). Because the cooling/heating devices are grouped into groups as described above, a defrosting period and a defrosting cycle may be set for each of the groups. The effort can be reduced, compared with that in a case in which the defrosting period and the defrosting cycle are set for each of the cooling/heating devices.

However, in defrosting control disclosed in Japanese Unexamined Patent Application Publication No. 2008-111625, the power consumptions of showcases, which serve as cooling/heating devices, during a recovery operation (a pull-down operation) of cooling the inside of the showcases again after defrosting is performed are not considered. For example, in a case of a store for which an upper limit value of the power consumption of the store is set by an electric power company, when increases in the power consumptions during the pull-down operation and an increase in the power consumption caused by the operation of the store coincide with each other, the sum of the power consumptions may exceed the set upper limit value.

SUMMARY

Accordingly, in some embodiments of the present invention, an apparatus for managing operation of refrigerating machines is provided, which apparatus enabling to perform operation control for cooling/heating devices so as to realize defrosting control with consideration of increases in power consumptions, during a pull-down operation, of the cooling/heating devices, and preventing electric power from exceeding a predetermined maximum demand.

In order to address the above-described and/or other issues, according to the preferred embodiments of the present invention, there is provided an apparatus for managing operation of refrigerating machines. The apparatus for managing operation of refrigerating machines according to the preferred embodiments of the present invention controls defrosting of an evaporator of each of a plurality of refrigeration cycles. Each of the plurality of refrigeration cycles uses at least a compressor, a condenser, a decompressor, and the evaporator, and is formed for a corresponding one of cooling/heating devices which are installed in a single store. Each of the cooling/heating devices is configured to be capable of a cooling target to be cooled by utilizing an effect of heat absorption in a case of evaporation of a refrigerant in the evaporator. The apparatus includes a storage section, a power consumption estimating section, and a defrosting shift controller. The storage section stores, for each of the plurality of refrigeration cycles, a defrosting start time or defrosting end time and a power consumption during a pull-down operation. The power consumption during the pull-down operation is a power consumption which is necessary for the pull-down operation performed for a corresponding one of the cooling/heating devices after defrosting is performed. The power consumption estimating section estimates a power consumption of the store for each of predetermined time periods. The power consumption of the store includes at least the power consumptions of the plurality of refrigeration cycles. The defrosting shift controller changes the defrosting start time or defrosting end time so that a total estimated power consumption does not exceed an upper limit value of a power consumption when the pull-down operation is performed. The total estimated power consumption is obtained by adding the power consumption during the pull-down operation stored in the storage section to the power consumption estimated by the power consumption estimating section. The upper limit value of the power consumption is set in advance by the store.

With the apparatus for managing operation of refrigerating machines according to the preferred embodiments of the present invention, by controlling the defrosting start time or defrosting end time of each of the plurality of refrigeration cycles, operation of refrigerating machines can be performed, for a power consumption that is estimated as an amount of electric power to be consumed by the operation of the store, with consideration of an increase in the power consumption during the pull-down operation after defrosting is performed. Accordingly, in a case of a store for which an upper limit value of the power consumption of the store is set by an electric power company, the sum of the power consumption of the store and the power consumption caused by the pull-down operation can be prevented from exceeding the upper limit value that is set in advance. In this case, the power consumptions of some of the plurality of refrigeration cycles may not be used for estimation.

Furthermore, in the apparatus for managing operation of refrigerating machines according to the preferred embodiments of the present invention, it is preferable that, when the total estimated power consumption exceeds the upper limit value of the power consumption that is set in advance by the store, the defrosting shift controller swap, among the plurality of refrigeration cycles, the defrosting start time or defrosting end time of one refrigeration cycle and the defrosting start time or defrosting end time of another refrigeration cycle.

The plurality of refrigeration cycles have different power consumptions that differ in accordance with installed devices or use states. With the apparatus for managing operation of refrigerating machines according to the preferred embodiments of the present invention, even when the total estimated power consumption exceeds the upper limit value of the power consumption that is set in advance by the store, by swapping the defrosting start times or defrosting end times of the plurality of refrigeration cycles having the different power consumptions, the sum of a power consumption that is an amount of electric power consumed by the operation of the store in reality and the power consumption caused by the pull-down operation can be prevented from exceeding the upper limit value that is set in advance.

Moreover, in the apparatus for managing operation of refrigerating machines according to the preferred embodiments of the present invention, it is preferable that, for a power consumption of the store for a day, the storage section divide 24 hours into 30-minute time periods, evaluate the integral of electric power consumed by the store for each of the 30-minute time periods over an interval of 30 minutes to obtain a value, and store the value as a past power consumption.

With the apparatus for managing operation of refrigerating machines according to the preferred embodiments of the present invention, the total estimated power consumption can be estimated on the basis of the past power consumptions that are stored in the storage section for the 30-minute time periods. Thus, a more specific total estimated power consumption can be estimated.

Additionally, in the apparatus for managing operation of refrigerating machines according to the preferred embodiments of the present invention, it is preferable that the storage section store a room temperature or outside air temperature of the store and a power consumption for each of the predetermined time periods. The power consumption for the predetermined time period corresponds to a change in the room temperature or outside air temperature. It is preferable that the power consumption estimating section estimate the total estimated power consumption for each of the predetermined time periods on the basis of a measured room temperature or outside air temperature of the store and a change in the measured room temperature or outside air temperature and on the basis of the room temperature or outside air temperature of the store and the power consumption for the predetermined time period which are stored in the storage section. The power consumption for the predetermined time period corresponds to the change in the room temperature or outside air temperature.

With the apparatus for managing operation of refrigerating machines according to preferred embodiments of the present invention, the total estimated power consumption can be estimated with consideration of the relationship between the measured room temperature or outside air temperature of the store and the change in the measured room temperature or outside air temperature and the room temperature or outside air temperature of the store and the change in the room temperature or outside air temperature which are stored in the storage section. Thus, a more accurate total estimated power consumption can be estimated.

Furthermore, in the apparatus for managing operation of refrigerating machines according to the preferred embodiments of the present invention, it is preferable that the storage section store a weather condition and a power consumption for each of the predetermined time periods. The power consumption for the predetermined time period corresponds to a change in the weather condition. It is preferable that the power consumption estimating section estimate the total estimated power consumption for each of the predetermined time periods on the basis of an observed weather condition and a change in the observed weather condition and on the basis of the weather condition and the power consumption for the predetermined time period which are stored in the storage section. The power consumption for the predetermined time period corresponds to the change in the weather condition.

With the apparatus for managing operation of refrigerating machines according to the preferred embodiments of the present invention, the total estimated power consumption can be estimated with consideration of the relationship between the observed weather condition and the change in the observed weather condition and the weather condition and the change in the weather condition which are stored in the storage section. Thus, a more accurate total estimated power consumption can be estimated.

Moreover, in the apparatus for managing operation of refrigerating machines according to the preferred embodiments of the present invention, it is preferable that the storage section store power consumptions for each of the predetermined time periods for the past year with respect to a time when the total estimated power consumption was most recently estimated.

With the apparatus for managing operation of refrigerating machines according to the preferred embodiments of the present invention, comparison with data regarding the power consumptions for the past year can be performed, and the data can be referred to. Thus, a more accurate power consumption can be estimated.

Additionally, in the apparatus for managing operation of refrigerating machines according to the preferred embodiments of the present invention, it is preferable that the storage section store power consumptions for each of the predetermined time periods for at least the past ten days with respect to a time when the power consumption was most recently estimated, and that the power consumption estimating section estimate the total estimated power consumption for each of the predetermined time periods with reference to an average value of the power consumptions for the predetermined time period for at least the past ten days.

With the apparatus for managing operation of refrigerating machines according to the preferred embodiments of the present invention, the total estimated power consumption is estimated using the average value of the power consumptions for the past ten days. Thus, an accurate power consumption can be estimated.

Furthermore, in the apparatus for managing operation of refrigerating machines according to the preferred embodiments of the present invention, it is preferable that the power consumption estimating section estimate the total estimated power consumption for each of the predetermined time periods for at least the following three hours with respect to a time when the power consumption was most recently estimated.

With the apparatus for managing operation of refrigerating machines according to the preferred embodiments of the present invention, the total estimated power consumption is estimated for at least the following three hours. Thus, the tendency of change in the power consumption can be easily revealed, and shifting of the defrosting start time or defrosting end time can be easily performed.

Moreover, in the apparatus for managing operation of refrigerating machines according to the preferred embodiments of the present invention, it is preferable that estimation of the total estimated power consumption by the power consumption estimating section be performed every hour with respect to a time when the total estimated power consumption was most recently estimated.

With the apparatus for managing operation of refrigerating machines according to the preferred embodiments of the present invention, because estimation of the total estimated power consumption is performed every hour, the total estimated power consumption can be corrected in accordance with a sudden change in temperature or change in weather condition. Thus, a more accurate power consumption can be estimated.

Additionally, in the apparatus for managing operation of refrigerating machines according to the preferred embodiments of the present invention, it is preferable that the defrosting shift controller include a calculation unit, a group setting unit, a group information storage unit, and a defrosting controller. The calculation unit acquires device information concerning each of the cooling/heating devices, and calculates a defrosting period and a defrosting cycle of the cooling/heating device on the basis of the device information concerning the cooling/heating device. The group setting unit sets a plurality of groups on the basis of the defrosting periods and the defrosting cycles which have been calculated by the calculation unit. Each of the plurality of groups is a set of the cooling/heating devices whose defrosting periods are the same and whose defrosting cycles are the same. The group information storage unit stores group information including at least power consumptions associated with the plurality of groups which have been set by the group setting unit. On the basis of the power consumptions included in the group information stored in the group information storage unit, the defrosting controller determines an order for each of the plurality of groups, and performs defrosting control on the cooling/heating devices belonging to the group.

The apparatus for managing operation of refrigerating machines according to the preferred embodiments of the present invention calculates the defrosting periods and the defrosting cycles of the cooling/heating devices. The apparatus for managing operation of refrigerating machines sets a plurality of groups on the basis of the defrosting periods and the defrosting cycles, and each of the plurality of groups is a set of the cooling/heating devices whose defrosting periods are the same and whose defrosting cycles are the same. Moreover, the apparatus for managing operation of refrigerating machines stores the group information that is information concerning the plurality of set groups. With the apparatus for managing operation of refrigerating machines according to the preferred embodiments of the present invention, as a result of such setting of groups, for each of the plurality of groups, defrosting of the cooling/heating devices belonging to the group is performed on the basis of the group information, and the times at which defrosting is performed for the individual groups are different from one another. Thus, the power consumptions, during the pull-down operation, of the cooling/heating devices can be prevented from becoming excessively high, and, further, the power consumption of the entire store can be prevented from exceeding the upper limit value.

Furthermore, in the apparatus for managing operation of refrigerating machines according to the preferred embodiments of the present invention, it is preferable that the defrosting shift controller further include a first group resetting unit. When a total value of the power consumptions, during the pull-down operation, of the cooling/heating devices belonging to one group among the plurality of groups is equal to or higher than the upper limit value of the power consumption that is set in advance by the store, the first group resetting unit divides the one group so as to set a new group.

When a total value of the power consumptions, during the pull-down operation, of the cooling/heating devices belonging to a predetermined group among the plurality of groups that have been set by setting groups is equal to or higher than a threshold, the apparatus for managing operation of refrigerating machines according to the preferred embodiments of the present invention divides the predetermined group so as to set a new group. Thus, the power consumptions, during the pull-down operation, of the cooling/heating devices can be prevented from becoming excessively high, and, further, the power consumption of the entire store can be prevented from exceeding the upper limit value.

Moreover, in the apparatus for managing operation of refrigerating machines according to the preferred embodiments of the present invention, it is preferable that the defrosting shift controller further include a second group resetting unit. When all of the cooling/heating devices connected via a refrigerant pipe to one refrigerating machine belong to only one group among the plurality of groups, the second group resetting unit divides the one group so as to set a new group.

When all of the cooling/heating devices connected via a refrigerant pipe to one refrigerating machine belong to the only predetermined group among the plurality of groups, the apparatus for managing operation of refrigerating machines according to the preferred embodiments of the present invention divides the predetermined group so as to set a new group. Thus, the power consumptions, during the pull-down operation, of the cooling/heating devices can be prevented from becoming excessively high because the pull-down operation is simultaneously performed for all of the cooling/heating devices connected to the one refrigerating machine, and, further, the power consumption of the entire store can be prevented from exceeding the upper limit value.

Additionally, in the apparatus for managing operation of refrigerating machines according to the preferred embodiments of the present invention, it is preferable that the defrosting shift controller further include a third group resetting unit. When defrosting of all of the cooling/heating devices has not been completed within a predetermined time period, the third group resetting unit combines at least two groups among the plurality of groups together so as to set a new group.

When defrosting of all of the cooling/heating devices has not been completed within a time period of a minimum defrosting cycle among the defrosting cycles corresponding to the plurality of groups, the apparatus for managing operation of refrigerating machines according to the preferred embodiments of the present invention combines at least two groups among the plurality of groups together so as to set a new group. Thus, the power consumptions, during the pull-down operation, of the cooling/heating devices can be prevented from becoming excessively high because the pull-down operation is simultaneously performed for the cooling/heating devices belonging to the plurality of groups, and, further, the power consumption of the entire store can be prevented from exceeding the upper limit value.

Furthermore, in the apparatus for managing operation of refrigerating machines according to the preferred embodiments of the present invention, it is preferable that the defrosting shift controller further include a fourth group resetting unit. The fourth group resetting unit causes, among the plurality of groups, at least some of the cooling/heating devices belonging to a group corresponding to a time slot in which a total value of a power consumption of a device other than the cooling/heating devices and the power consumptions of the cooling/heating devices in the store in which the cooling/ heating devices are installed becomes a maximum, to belong to another group. The fourth group resetting unit swaps, among the plurality of groups, a time slot corresponding to a group corresponding to the time slot in which a total value of a power consumption of a device other than the cooling/heating devices and the power consumptions of the cooling/heating devices in the store in which the cooling/heating devices are installed becomes a maximum and a time slot corresponding to another group.

When the pull-down operation is performed for cooling/heating devices among the cooling/heating devices in a time slot in which the power consumption of the entire store reaches a peak and a group to which the cooling/heating devices belong exists, the apparatus for managing operation of refrigerating machines according to the preferred embodiments of the present invention causes at least some of the cooling/heating devices belonging to the group to belong to another group. Regarding the cooling/heating devices for which the pull-down operation is performed in a time slot in which the power consumption of the entire store reaches a peak, the apparatus for managing operation of refrigerating machines according to the preferred embodiments of the present invention swaps a defrosting time slot corresponding to a group to which the cooling/heating devices belong and a defrosting time slot corresponding to another group. Thus, the peak of the power consumption of the entire store can be reduced.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The above and/or other exemplary features and advantages of the preferred embodiments of the present invention will become more apparent through the detailed description of exemplary embodiments thereof with reference to the accompanying drawings, in which:

FIG. 7 is a table of data that is necessary for defrosting shift control;

FIG. 8A is a table illustrating a state in which defrosting start times have not been shifted by performing defrosting shift control, and FIG. 8B is a table illustrating a state in which the defrosting start times have been shifted by performing defrosting shift control;

FIG. 10A is a table illustrating a state in which defrosting start times have not been shifted by performing defrosting shift control, and FIG. 10B is a table illustrating a state in which the defrosting start times have been shifted by performing defrosting shift control;

DESCRIPTION OF THE PREFERRED EMBODIMENTS

Hereinafter, some illustrative and non-limiting embodiments of the present invention will be described in detail with reference to the drawings. However, the embodiments given below are provided for the purpose of describing examples of apparatuses for managing operation of refrigerating machines in order to realize the technical concept of the present invention. It is not intended that the present invention is limited to the apparatuses for managing operation of refrigerating machines described in the embodiments. The present invention may also be equally applied to other embodiments included in the scope of the claims.

First Embodiment

Some illustrative examples of cooling/heating devices used for stores include showcases for chilling and freezing, refrigerators and freezers that are installed in, e.g., kitchens or backyards, and air conditioners used for stores. For example, in an example of a showcase, an outdoor unit having a compressor and a condenser is placed outside or on a rooftop, and an indoor unit having an evaporator and a decompressor is placed inside a store. Typically, a plurality of indoor units and a single outdoor unit are installed so that the indoor units are connected, using refrigerant pipes, to the outdoor unit in parallel to form refrigeration cycles. Furthermore, in the store, although not illustrated, a large number of devices that consume electric power, such as illumination devices and heating cooking devices, are also installed.

Figure 1:
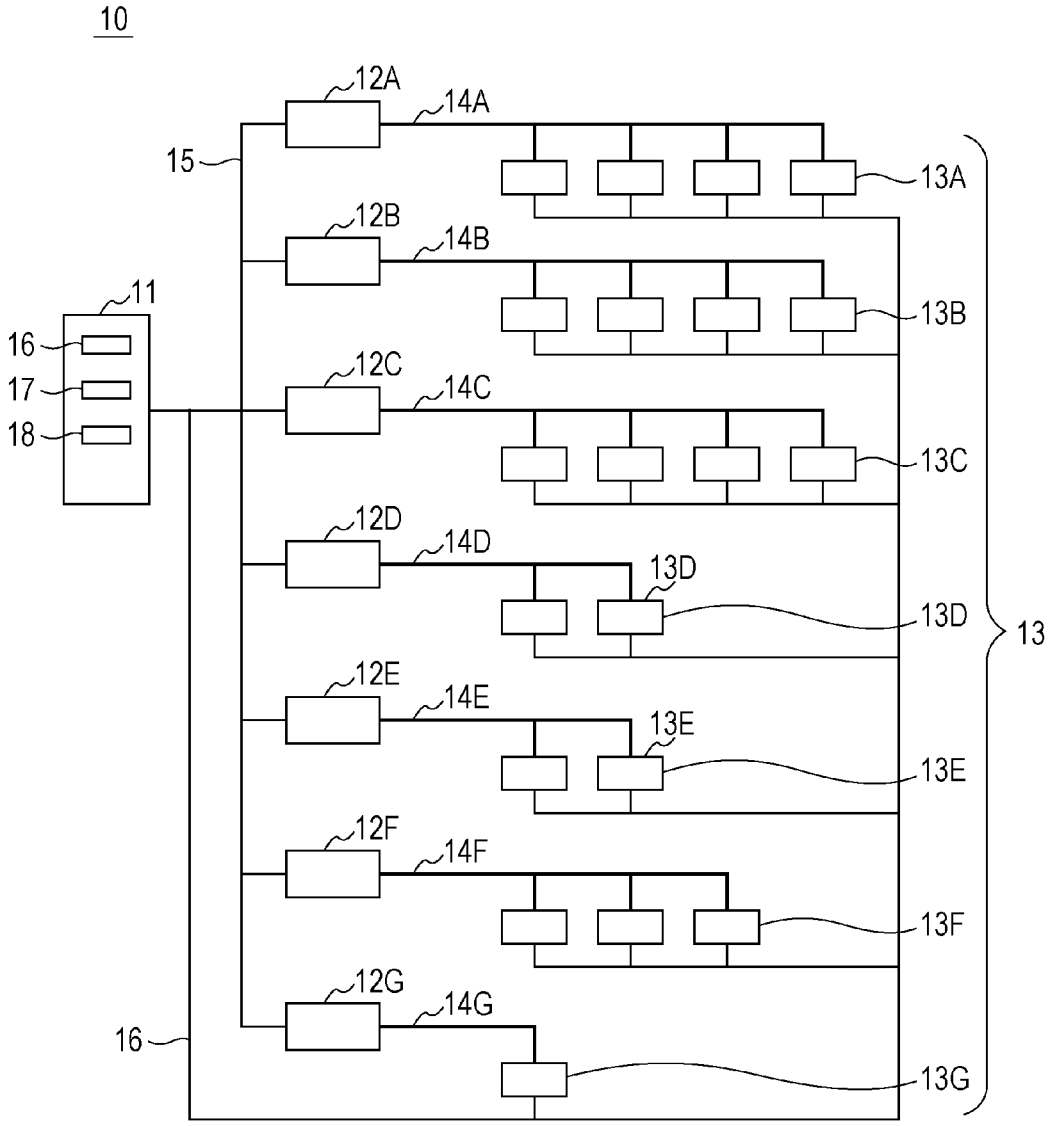
FIG. 1 is a schematic diagram of a store in a first embodiment.

Note that, in a first embodiment, as illustrated in FIG. 1, an illustrative example in which a store 10 is a supermarket is provided. A case is described, in which seven refrigerating machines 12A to 12G (hereinafter, may simply be referred to as "refrigerating machines 12" when it is not necessary to distinguish the refrigerating machines 12A to 12G from one another) that serve as outdoor units are installed, and in which one cooling/heating device 13 or two, three, or four cooling/heating devices 13 that serve as indoor units connected to each of the refrigerating machines 12 are installed. Note that, in the first embodiment, showcases 13A to 13C and 13G and air conditioners 13D to 13F that are installed as the cooling/heating devices 13 in the store 10 are provided and described as examples.

Furthermore, the individual refrigerating machines 12 are connected, using signal lines 15, to an apparatus 11 for managing operation of refrigerating machines (hereinafter, may be referred to as an "operation managing apparatus 11"). The operation managing apparatus 11 performs, for example, for each of the showcases 13A to 13C and 13G and the air conditioners 13D to 13F, the following: management of a time at which a shift signal for a temperature set value is output for the nighttime; management of, for air conditioning, an operation start time, a temperature set value, and outputting of a signal for switching between heating and cooling; and management of a lighting time for illumination. In addition, the operation managing apparatus 11 includes a storage section 16, a power consumption estimating section 17, and a defrosting shift controller 18. In the storage section 16, various set times, power consumptions, and so forth are stored. The power consumption estimating section 17 estimates a power consumption. The defrosting shift controller 18 performs management of a defrosting start time, and, on the basis of the power consumption estimated by the power consumption estimating section 17, for example, changes the defrosting start time or outputs a shift signal for a temperature set value of an air conditioner.

The individual refrigerating machines 12A to 12G are connected to the corresponding cooling/heating devices 13 using refrigerant pipes 14A to 14G (hereinafter, may simply be referred to as "refrigerant pipes 14" when it is not necessary to distinguish the refrigerant pipes 14A to 14G from one another), respectively. Note that, in the first embodiment, the showcases 13A to 13C and 13G are connected to the four refrigerating machines 12A to 12C and 12G, respectively, and the air conditioners 13D to 13F are connected to the three refrigerating machines 12D to 12F, respectively. In this manner, each of the refrigerating machines 12, the showcases 13A to 13C and 13G, and the air conditioners 13D to 13F is managed by the operation managing apparatus 11 via a corresponding one of the signal lines 15.

Figure 2:
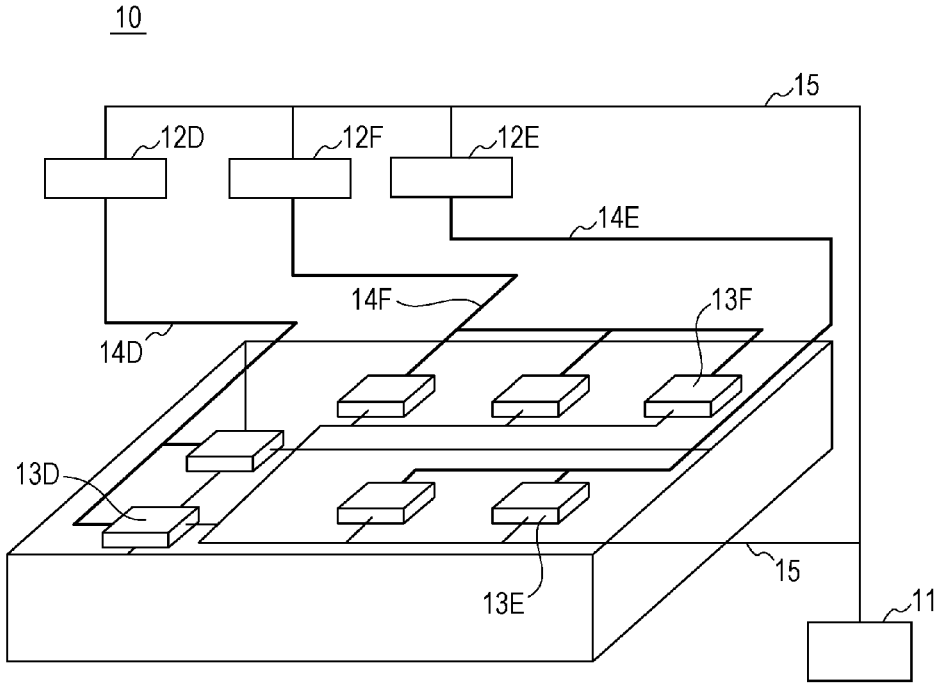
FIG. 2 is a schematic diagram of an air conditioner serving as a cooling/heating device.

Regarding a configuration of the air conditioners 13D to 13F serving as the cooling/heating devices 13, as illustrated in FIG. 2, the three refrigerating machines 12D to 12F are installed as outdoor units (depicted as outside of walls that surround the air conditioners in this illustrative example), and the two or three air conditioners 13D to 13F serving as the cooling/heating devices 13 are connected to the refrigerating machines 12D to 12F using the refrigerant pipes 14D to 14F, respectively. Each of the refrigerating machines 12D to 12F and the air conditioners 13D to 13F is connected to the operation managing apparatus 11 via a corresponding one of the signal lines 15. Operation of each of the refrigerating machines 12D to 12F and the air conditioners 13D to 13F is managed via managing apparatus 11.

Figure 3:
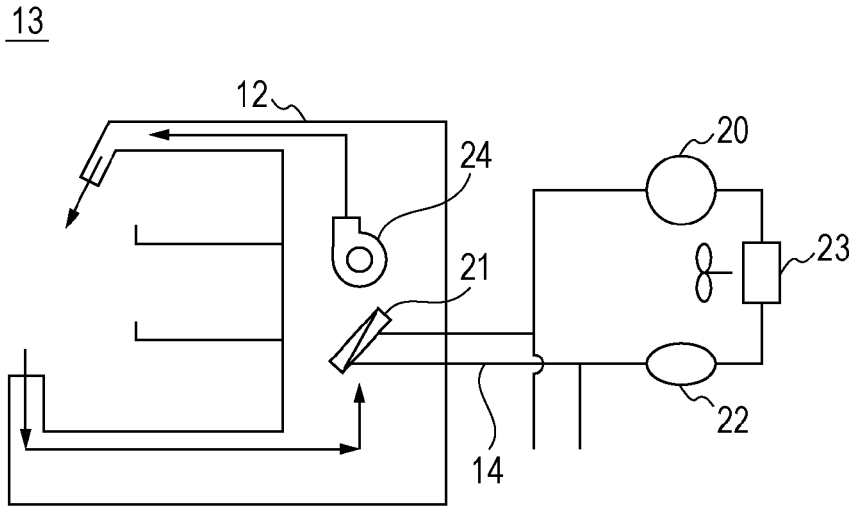
FIG. 3 is a schematic diagram of a showcase serving as a cooling/heating device.

As illustrated in FIG. 3, each of the showcases 13A to 13C and 13G serving as the cooling/heating devices 13 has an evaporator 21 therein. The air cooled by the evaporator 21 is circulated through each of the showcases 13A to 13C and 13G by utilizing a fan 24 so that products displayed in the showcase such as perishables or frozen food can be at an appropriate temperature. The evaporator 21 is provided in each of the showcase 13A to 13C and 13G. The evaporator 21, a compressor 20 and a condenser 23, which are included in each of the refrigerating machines 12A to 12C and 12G, and a decompressor 22 are connected in a loop using a corresponding one of the refrigerant pipes 14A to 14C and 14G, thereby forming a refrigeration cycle. Note that a cooling temperature differs in accordance with products displayed in each of the showcases 13A to 13C and 13G. For example, in some embodiments, the cooling temperature ranges from approximately −2° C. to 2° C. for fresh fish and meat, ranges from approximately 5° C. to 10° C. for fruit and vegetables, ranges from approximately 3° C. to 7° C. for daily foods, dairy products, and side dishes, and ranges from approximately −18° C. to −22° C. for frozen food and ice cream. Additionally, there are resulting differences among power consumptions of the showcases 13A to 13C and 13G due to the differences among the cooling temperatures thereof.

Figure 4:
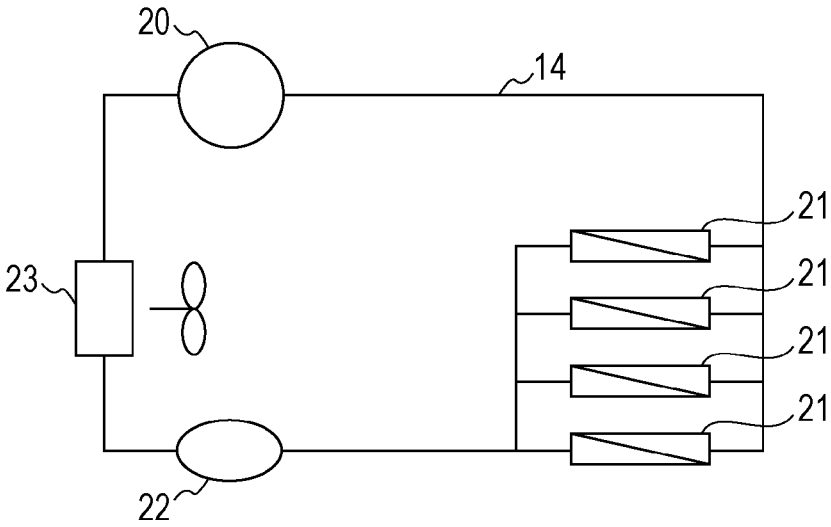
FIG. 4 is a schematic diagram illustrating a refrigeration cycle.

Here, an exemplary refrigeration cycle will be described. As illustrated in FIG. 4, the refrigeration cycle is formed by the compressor 20 and the condenser 23, which are included in each of the refrigerating machines 12, and the decompressor 22 and the evaporator 21, which are included in each of the showcases 13A to 13C and 13G and the air conditioners 13D to 13F serving as the cooling/heating devices 13. Note that, in the illustrative refrigeration cycle illustrated in FIG. 4, four evaporators 21, i.e., four cooling/heating devices 13, are connected to one compressor 20. Accordingly, in the refrigeration cycle illustrated in FIG. 4, the compressor 20, the condenser 23, and the decompressor 22 are provided as common components, and refrigeration cycles corresponding to the showcases 13A to 13C and 13G serving as the cooling/heating devices 13, i.e., four refrigeration cycles, exist.

In the refrigeration cycle, when the compressor 20 of the refrigerating machine 12 is activated, a high-temperature and high-pressure liquid refrigerant compressed by the compressor 20 is discharged from the compressor 20, and is input to the condenser 23 so as to be cooled. The cooled refrigerant enters a state in which gas and liquid are mixed, and flows into each of the evaporators 21 via the decompressor 22. In the decompressor 22, the refrigerant is decompressed so as to expand adiabatically, resulting in a reduction in the temperature. Additionally, the refrigerant evaporates in the evaporator 21, thereby absorbing heat of vaporization from the surroundings, so that the inside of the corresponding cooling/heating device 13 is cooled. A configuration is provided, in which the low-temperature low-pressure refrigerant vaporized in the evaporator 21 is circulated through the compressor 20 of the refrigerating machine 12.

Next, the evaporator 21 included in the cooling/heating device 13 will be described. The evaporator 21 is in a cooled state as described above. When the air that is being circulated through the cooling/heating device 13 contacts the cooled evaporator 21, moisture in the air condenses on the surface of the evaporator 21, resulting in deposition of frost. Moreover, the thermal conductivity of frost is low. Accordingly, when the cooling/heating device 13 continues operating while frost is being deposited on the evaporator 21, the cooling efficiency is reduced.

For this reason, in the cooling/heating device 13, a task of removing frost deposited on the evaporator 21 becomes necessary. The task of removing frost is performed by stopping operation of the compressor 20 of the refrigerating machine 12 so as to stop cooling the evaporator 21. In this case, operation of the fan 24 is continued so that wind continues hitting the evaporator 21, whereby the defrosting efficiency can be increased. Furthermore, a heater (not illustrated) serving as heating means is provided in the evaporator 21, whereby the defrosting efficiency can be further increased. After defrosting is completed, the operation of the compressor 20 of the refrigerating machine 12 is restarted.

Figure 5:
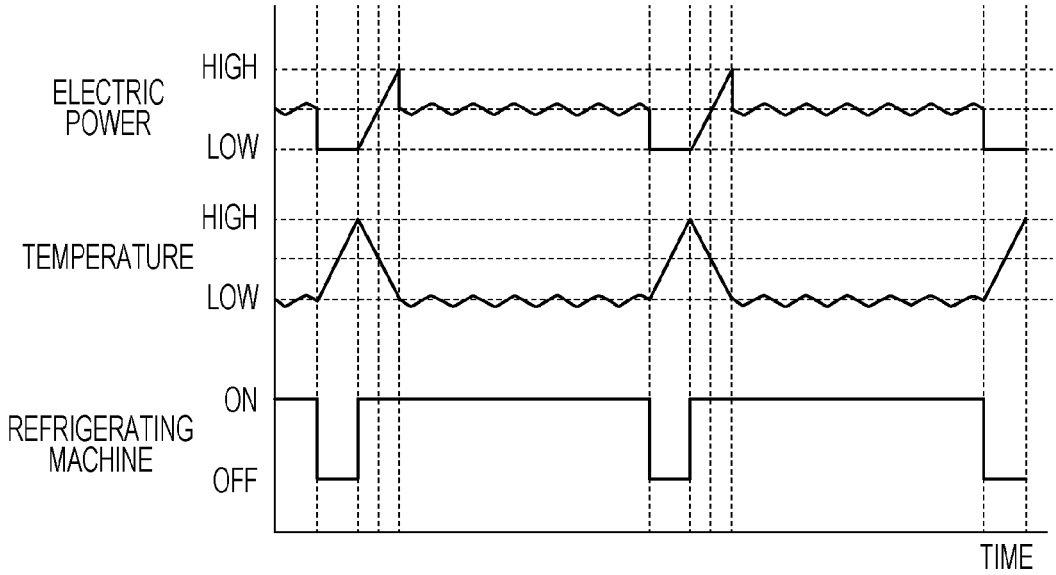
FIG. 5 is a graph illustrating the relationships between the electric power associated with a pull-down operation of a refrigerating machine and the temperature of a cooling/heating device.

Here, the change in the temperature of the cooling/heating device 13 and the electric power consumed by the compressor 20 of the refrigerating machine 12 after defrosting is completed will be described with reference to FIG. 5. When the operation of the refrigerating machine 12 is stopped (OFF) in order to perform defrosting, the electric power consumed by the refrigerating machine 12 decreases, but the temperature of the cooling/heating device 13 increases. It is supposed that a time period for which the refrigerating machine 12 is stopped is, for example, 30 minutes. Then, after defrosting is completed, in order to reduce the increased temperature of the inside of the cooling/heating device 13, operation of the compressor 20 of the refrigerating machine 12 is restarted (ON). Because, in this case, the refrigerating machine 12 operates so as to have the maximum output (hereinafter, referred to as a "pull-down operation"), the electric power consumed by the refrigerating machine 12 increases by a large amount. After that, when the temperature of the inside of the cooling/heating device 13 decreases and reaches about a temperature set value, control is performed so that the temperature of the inside of the cooling/heating device 13 is maintained constant. The electric power consumed by the refrigerating machine 12 also repeatedly increases and decreases in synchronization with the control. Defrosting is repeatedly performed at fixed intervals.

Figure 6:
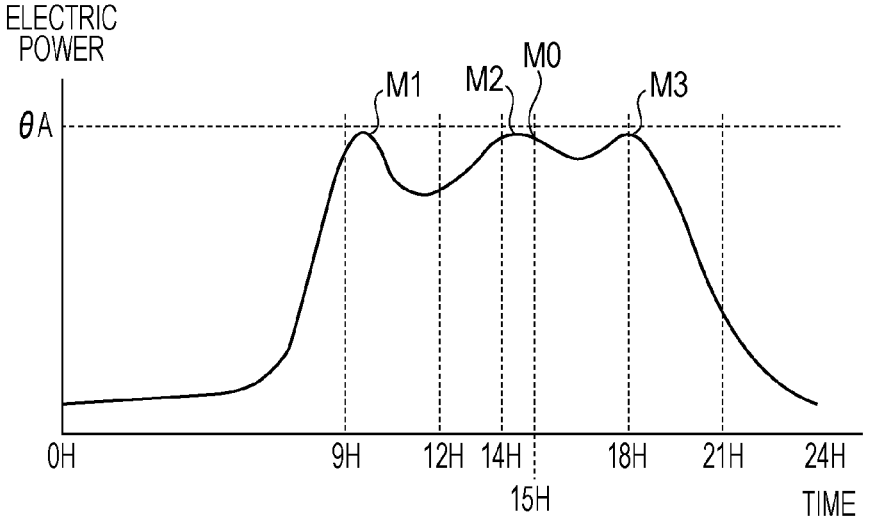
FIG. 6 is a graph of change in electric power consumed by the store over a day.

Next, electric power consumed by the entire store 10, which is, e.g., a supermarket, will be described with reference to FIG. 6. FIG. 6 is a graph illustrating an example of change in electric power consumed by a typical supermarket. In this graph, a first peak M1 appears about a few minutes past 9 a.m. (9 H) when the supermarket opens. The reason for this is that various types of equipment start operating in preparation for opening of the supermarket. After that, although the electric power consumed by the supermarket temporarily decreases, a second peak M2 appears between 2 p.m. (14 H) to 3 p.m. (15 H). The reason for this is that refrigerating machines and so forth intensively operate in order to maintain the temperature of products which need to be cooled, because a time slot from 2 p.m. to 3 p.m. is a time slot in which the temperature reaches the maximum in the daytime. After that, although the electric power consumed by the supermarket temporarily decreases again, the electric power consumed by the supermarket increases again at about 6 p.m., resulting in appearance of a third peak M3. The reason for this is that cooling is necessary because the number of customers who come and go increases. Then, the electric power consumed by the supermarket decreases in preparation for closing of the supermarket at 9 p.m. (21 H). Note that θA denotes a maximum demand for which the supermarket has a contract with an electric power company. When the electric power consumed by the supermarket exceeds the maximum demand, there is a risk of power outage due to the tripping of the breaker. Note that, because the graph illustrates an example of change in electric power consumed by, e.g., a supermarket, changes in consumed power are not limited thereto, and the number of peaks may increase or decrease.

Next, the relationships between the electric power consumed by the refrigerating machines 12 and the electric power consumed by the store 10, which is, e.g., a supermarket, will be described with reference to FIGS. 5 and 6. As described above, the evaporators 21 included in the cooling/heating devices 13A to 13C and 13G need defrosting. After defrosting is performed, the pull-down operation is certainly performed, in which the electric power consumed by the refrigerating machines 12 sharply increases in order to perform cooling. In this case, in the first embodiment, because the seven refrigerating machines 12 are installed, when some of the seven refrigerating machines 12 perform the pull-down operation in the same time slot, the electric power consumed by the refrigerating machines 12 more sharply increases.

In contrast, as illustrated in FIG. 6, the electric power consumed by the store 10, which is, e.g., a supermarket, is not constant. When the pull-down operation of the refrigerating machines 12 is performed simultaneously with any one of the peaks (M1 to M3) of the electric power consumed by the supermarket, the electric power consumed by the entire supermarket sharply increases. Accordingly, as with a peak 0 illustrated in FIG. 6, the electric power consumed by the supermarket may exceed the maximum demand for which the supermarket has a contract with the electric power company.

Note that it is considered that the times at which defrosting is performed are shifted in advance from the times at which the peaks of the electric power consumed by the supermarket appear. However, the graph of FIG. 6 illustrates an example of the electric power consumed by the supermarket, and the electric power consumed by the supermarket does not necessarily change as illustrated in the graph. The times at which the peaks of the electric power consumed by the supermarket appear may shift in accordance with temperature or the number of customers. Accordingly, it is difficult to change, on an individual basis, for a daily power consumption, the times at which defrosting is performed. Thus, in the operation managing apparatus 11 according to the first embodiment, control of shifting the defrosting start time is performed by the defrosting shift controller 18 (see FIG. 1).

First, data necessary for control of shifting the defrosting start time (hereinafter, referred to as "defrosting shift control") will be described. Data illustrated in FIG. 7 includes data regarding the refrigerating machines 12 and data regarding, for example, the power consumption of the store 10, which are stored in the storage section 16 as data necessary for defrosting shift control. The data stored in the storage section 16 in this case includes, for each of the refrigerating machines 12A to 12G, for example, a defrosting cycle C, a defrosting period t, a pulldown period Pt, a power consumption P during the pull-down operation, a shift direction, past power consumptions, and changes in the temperature and weather conditions for the past time periods.

Hereinafter, a specific example of data regarding each of the refrigerating machines in the first embodiment will be described. In the first embodiment, because the seven refrigerating machines 12A to 12G are installed, data regarding the seven refrigerating machines 12A to 12G is stored. The defrosting cycle C is data regarding a cycle of defrosting performed by each of the refrigerating machines 12. The defrosting cycle C differs in accordance with the necessity of defrosting that depends on the use state of the cooling/heating devices 13 connected to each of the refrigerating machines 12. It is supposed that the defrosting cycle C is about three to five hours. The defrosting period t is a time period for which defrosting is performed. In the first embodiment, the defrosting period t of each of the refrigerating machines 12 is set to 30 minutes. The pulldown period Pt is a time period for which the pull-down operation is performed. In the first embodiment, the pulldown period Pt of each of the refrigerating machines 12 is set to 30 minutes.

The power consumption P during the pull-down operation is an amount of electric power that is consumed by each of the refrigerating machines 12A to 12G during the pull-down operation, and differs in accordance with each of the refrigerating machines 12A to 12G. The shift direction is determined on the basis of a shift priority level of each of the cooling/heating devices 13. The shift priority level is determined on the basis of the type of cooling/heating device 13, more particularly, on the basis of products displayed in each of the showcases 13A to 13C and 13G. Considering that the shift priority level is high for products, such as raw food, that need to be cooled, the defrosting start time is shifted forward. In contrast, considering that the shift priority level is low for products such as frozen products or chilled products because the quality of the products is not easily influenced even when the cooling efficiency is reduced, the defrosting start time is shifted backward. Note that, also in a case in which the cooling/heating devices 13 are the air conditioners 13D to 13F, the shift priority level is appropriately set with consideration of the power consumption or air-conditioning range of each of the air conditioners 13D to 13F, and, then the shift direction is appropriately set.

An estimated power consumption A is calculated by the power consumption estimating section 17 on the basis of the data stored in the storage section 16. It is preferable that the estimated power consumption A be corrected in accordance with the day's temperature or weather conditions so that a more specific power consumption can be estimated. Note that a method for calculating the estimated power consumption A will be described below.

Next, shifting of the defrosting start time will be described. First, estimation of a power consumption by the power consumption estimating section 17 will be described. In preparation for estimation, 24 hours in a day are divided in units of 30 minutes to obtain 30-minute time periods, and a past power consumption for each of the 30-minute time periods is stored in the storage section 16. The power consumption stored in this case is, for example, a value that is obtained by graphing consumed electric power and by evaluating the integral of the consumed electric power over an interval of 30 minutes. Among the power consumptions stored in this manner, the average value of the power consumptions for the same 30-minute time period for a certain term, e.g., the past ten days, is obtained, and is used as the estimated power consumption A. Estimation of a power consumption as the estimated power consumption A in this manner is performed for a certain time period, e.g., for the following three hours. The average value of the power consumptions is corrected in accordance with a change in the day's temperature or weather conditions, and then determined as the estimated power consumption A. Correction of the average value of the power consumptions may also be performed using the data stored in the storage section 16. Determination may be performed using the difference between the average value of temperature for ten days and the day's temperature or the differences in the power consumption depending on the weather conditions may be stored in advance, and, then, the average value of the power consumptions may be corrected to obtain a corrected value. Furthermore, when power consumptions and the temperature and weather conditions for the past year are stored in the storage section 16 as data used to determine a corrected value in this case, a more specific corrected value can be obtained, whereby a power consumption can be accurately estimated.

Then, the power consumptions P, during the pull-down operation, of the individual refrigerating machines 12A to 12G, which are stored in the storage section 16, are added to the estimated power consumption A to obtain a total estimated power consumption AT. Whether or not the total estimated power consumptions AT for the following three hours exceed a contracted amount θA of electric power, for which the store 10 has a contract with the electric power company is determined. Then, when it is determined that the total estimated power consumptions AT exceed the contracted amount θA of electric power, a refrigerating machine whose defrosting start time is to be shifted is determined with reference to the shift priority level (the shift direction). Shifting of the defrosting start time is performed on the basis of the total estimated power consumptions AT that have been estimated by the power consumption estimating section 17 for the following three hours. Defrosting shift control is appropriately performed on operation of the refrigerating machines 12 so that the optimum operation for products displayed in the showcases can be performed, and further, the optimum air-conditioning control can be performed.

Next, defrosting shift control will be specifically described with reference to FIGS. 8A to 11C. In FIG. 8A, the estimated power consumptions of the refrigerating machines for the following three hours in the first embodiment are illustrated. Estimation time periods T1 to T6 are 30-minute time periods starting with a 30-minute time period following a 30-minute time period including the current time among the 30-minute time periods obtained by dividing 24 hours in units of 30 minutes. Each of estimated power consumptions A1 to A6 is obtained using the average value of the power consumptions for the same 30-minute time period for the past ten days, and provided as an amount of electric power that is supposed to be consumed for a corresponding one of the estimation time periods T1 to T6. Note that the estimated power consumptions have been corrected in accordance with the day's temperature or weather conditions or the like. The power consumptions P during the pull-down operation are amounts of electric power consumed when the individual refrigerating machines performed the pull-down operation. The total estimated power consumption AT is obtained by adding the power consumptions P (a to f) during the pull-down operation to each of the estimated power consumptions A1 to A6, whereby the total estimated power consumptions AT corresponding to the estimated power consumptions A1 to A6 are obtained. Comparison with the contracted amount of electric power indicates determination of whether the total estimated power consumption AT exceeds the contracted amount θA of electric power for which the store 10 has a contract with the electric power company.

Figure 9A:
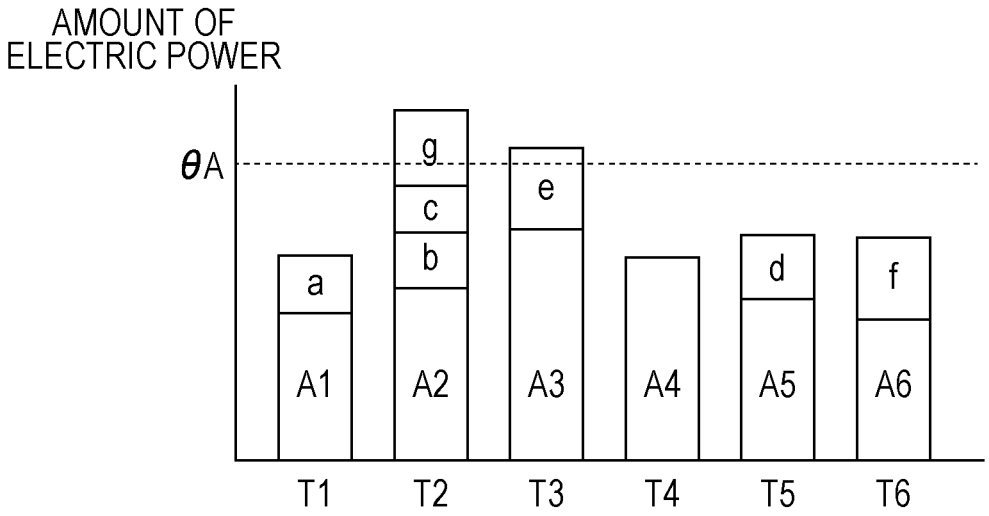
FIG. 9A is a bar graph illustrating the state in which the defrosting start times have not been shifted by performing defrosting shift control.
Figure 9B:
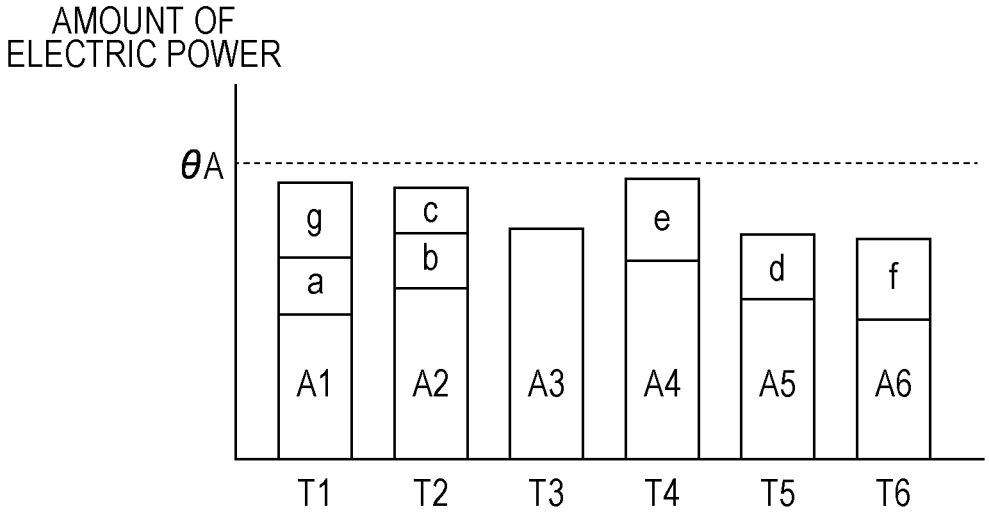
FIG. 9B is a bar graph illustrating the state in which the defrosting start times have been shifted by performing defrosting shift control.
Figure 11A:
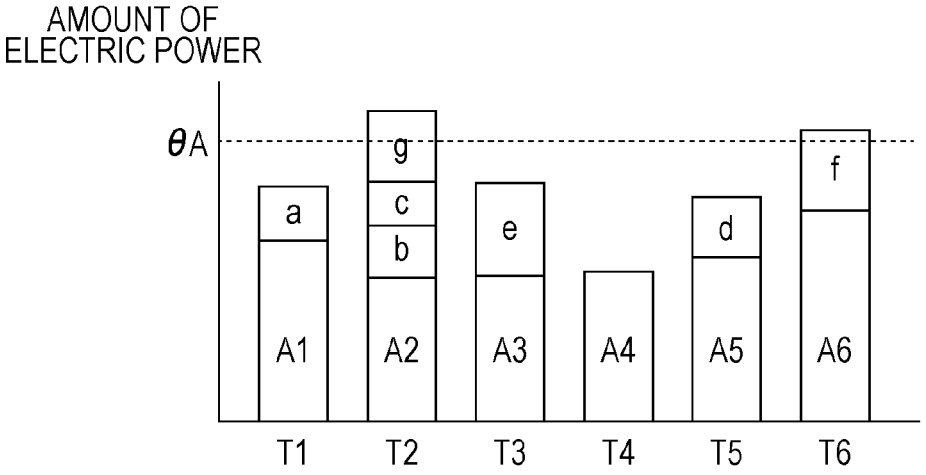
FIG. 11A is a bar graph illustrating the state in which the defrosting start times have not been shifted by performing defrosting shift control.
Figure 11B:
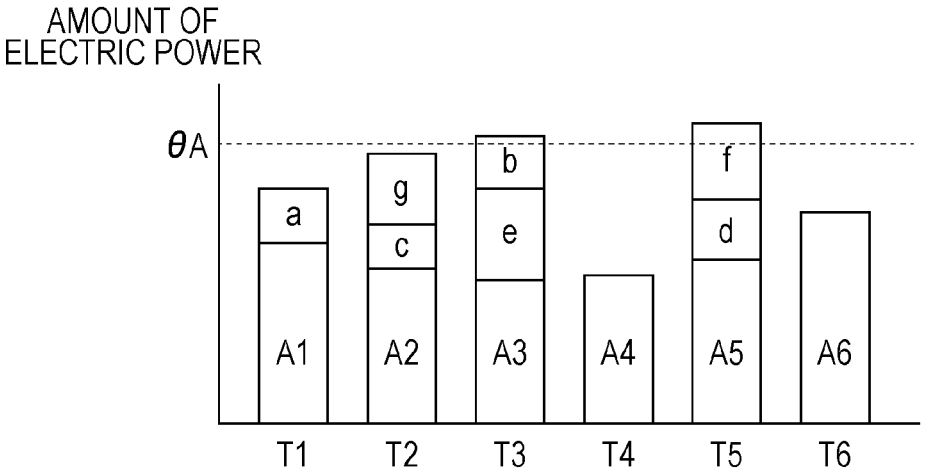
FIG. 11B is a bar graph illustrating a state in which the defrosting start times are being shifted by performing defrosting shift control.
Figure 11C:
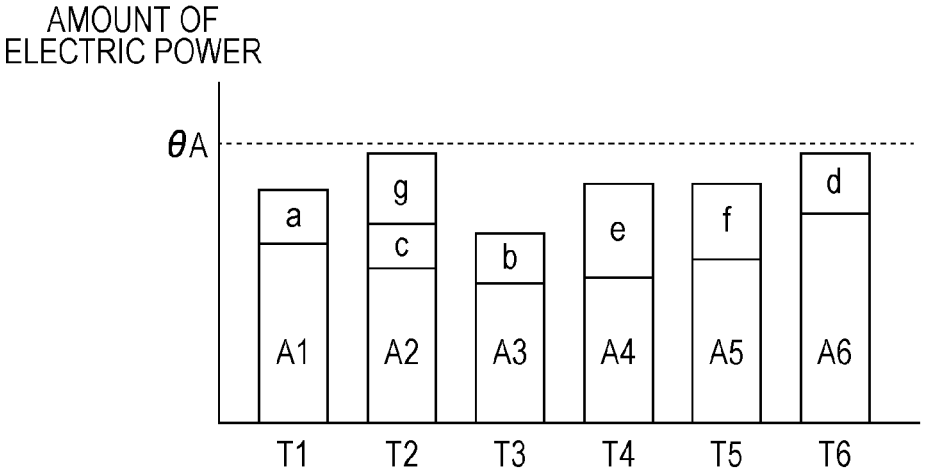
FIG. 11C is a bar graph illustrating the state in which the defrosting start times have been shifted by performing defrosting shift control.

Shifting of the defrosting start time is performed on the basis of whether the total estimated power consumption AT exceeds the contracted amount θA of electric power. In other words, as illustrated in FIGS. 8A and 9A, because the total estimated power consumption AT exceeds the contracted amount θA of electric power for each of the estimation time periods T2 and T3, the defrosting start times included in each of the estimation time periods T2 and T3 need to be shifted. As illustrated in FIGS. 8B and 9B, first, one of the defrosting start times of the refrigerating machines 12A to 12C and 12G which are included in the estimation time T2 needs to be shifted. Here, referring to the shift priority level, the shift direction of each of the refrigerating machines 12B and 12C is the downward direction, and the shift direction of the refrigerating machine 12G is the upward direction. In this case, although the total estimated power consumption AT for the estimation time period T3 that is a shift destination to which each of the defrosting start times of the refrigerating machines 12B and 12C can be shifted exceeds the contracted amount θA of electric power, the total estimated power consumption AT for the estimation time period T1 that is a shift destination to which the defrosting start time of the refrigerating machine 12G can be shifted does not exceed the contracted amount θA of electric power. Accordingly, the defrosting start time of the refrigerating machine 12G is shifted to the estimation time period T1.

Similarly, regarding the estimation time period T3, the shift direction of the refrigerating machine 12D is the upward direction, and the shift direction of the refrigerating machine 12E is the downward direction. Here, when the defrosting start time of the refrigerating machine 12D is shifted to the estimation time period T2, the total estimated power consumption AT exceeds the contracted amount θA of electric power. Accordingly, the defrosting start time of the refrigerating machine 12E is shifted to the estimation time period T4. In this manner, the total estimated power consumptions AT for the following three hours do not exceed the contracted amount θA of electric power.

Next, another specific example will be described with reference to FIGS. 10A to 11C. FIG. 10A is similar to FIG. 8A. However, because the electric power consumed by the store 10, which is a supermarket, differs in accordance with a time slot for which estimation of a power consumption is performed (see FIG. 6), the estimation time period for which the total estimated power consumption AT exceeds the contracted amount θA of electric power differ. In other words, in the example illustrated in FIGS. 10A and 11A, the total estimated power consumption AT for each of the estimation time periods T2 and T6 exceeds the contracted amount θA of electric power.

In this case, defrosting shift control needs to be performed so that one of the defrosting start times of the refrigerating machines 12B, 12C, and 12G which are included in the estimation time period T2 is shifted. However, when one of the defrosting start times of the refrigerating machines 12B, 12C, and 12G is shifted, each of the estimation time periods T1 and T3 is a shift destination to which a corresponding one of the defrosting start times of the refrigerating machines 12B, 12C, and 12G has been shifted. The total estimated power consumption AT for each of the estimation time periods T1 and T3 after the corresponding defrosting start time has been shifted exceeds the contracted amount θA of electric power. In such a case, first, the defrosting start time of the refrigerating machine 12B is shifted in the downward direction. Then, because the total estimated power consumption AT for the estimation time period T3 exceeds the contracted amount θA of electric power, the defrosting start time of the refrigerating machine 12E is shifted to the estimation time period T4. In this manner, the minimum shifting of the defrosting start time of each of the refrigerating machines can be realized. Note that, in this case, the defrosting start time of the refrigerating machine 12C may be shifted. However, when the defrosting start time of the refrigerating machine 12G is shifted, the defrosting start time of the refrigerating machine 12A needs to be further shifted. Accordingly, the efficiency is reduced, which is not preferable. In this manner, a refrigerating machine whose defrosting start time is to be shifted can appropriately be selected.

Next, regarding the estimation time period T6, because the shift direction of the refrigerating machine 12F is the upward direction, the defrosting start time of the refrigerating machine 12F is shifted to the estimation time period T5. In this case, the total estimated power consumption At for the estimation time period T5 exceeds the contracted amount θA of electric power because the defrosting start time of the refrigerating machine 12F has been shifted. Accordingly, the defrosting start time of the refrigerating machine 12D is shifted. In this case, because the shift direction of the refrigerating machine 12D is the downward direction, the defrosting start time of the refrigerating machine 12D is shifted to the estimation time period T6. In other words, in this case, the defrosting start times of the refrigerating machines 12D and 12F are swapped. As described above, the total estimated power consumptions AT for the following three hours do not exceed the contracted amount θA of electric power.

Note that, although a case in which the seven refrigerating machines are installed is described in the first embodiment, when the area of the store is increased, a large number of combinations of multiple outdoor units and indoor units are installed. Defrosting is repeatedly performed in cycles that are set for each of the outdoor units. The cycle is set on the basis of the capability of the outdoor unit, whether to be frozen or chilled, air-conditioning capability, or the like. Even in such a case, the total estimated power consumption can be prevented from exceeding the contracted amount θA of electric power by repeating appropriate shifting of the defrosting start time. In this case, it is considered that the defrosting start time of a refrigerating machine is shifted to at least two estimation time periods. In this case, whether the defrosting start time can be shifted multiple times may be set in the shift priority level. Furthermore, although the defrosting shift controller shifts the defrosting start time in the first embodiment, the present invention is not limited thereto. The defrosting shift controller may shift a defrosting end time.

Second Embodiment

Next, a second embodiment will be described. In the first embodiment, a power consumption is estimated using the power consumptions of the refrigerating machines, and the estimated power consumption is prevented from exceeding the contracted amount of electric power. In contrast, in the second embodiment, using various types of information items concerning a plurality of cooling/heating devices connected to each of refrigerating machines, cooling/heating devices connected to the other refrigerating machines are grouped, and a reduction in power consumption is realized. Note that, in the second embodiment, as an illustrative example, it is supposed that the number of refrigerating machines is three, and a case in which three showcases serving as cooling/heating devices are connected to each of the refrigerating machines will be described.

Figure 12:
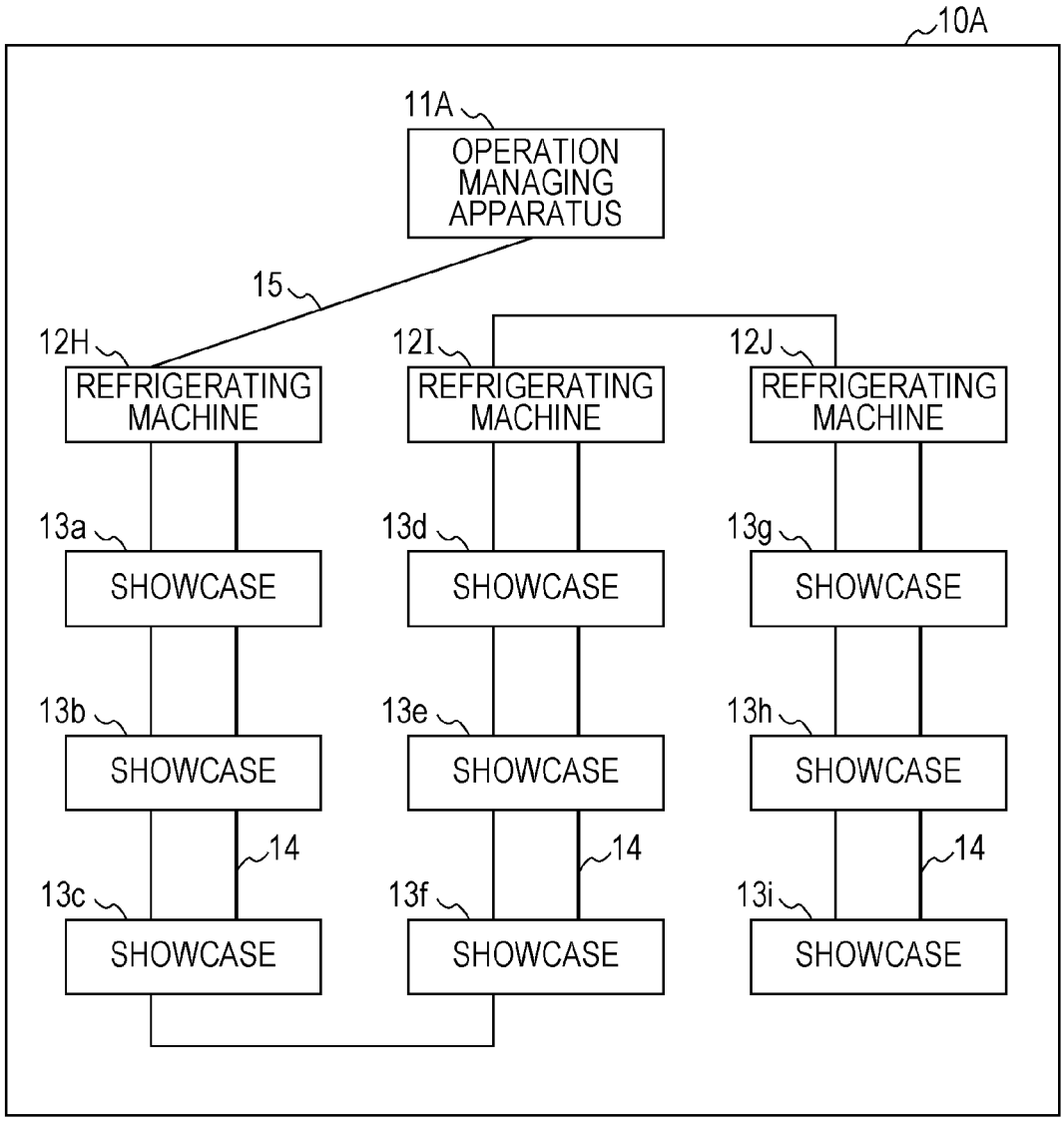
FIG. 12 is a schematic diagram of a store in a second embodiment.

FIG. 12 is a diagram schematically illustrating an overall configuration of a store 10A in the second embodiment of the present invention. An apparatus 11A for managing operation of refrigerating machines (hereinafter, may be referred to as an "operation managing apparatus 11A") illustrated in FIG. 12 is installed in the store 10A such as, e.g., a supermarket. The store 10A includes the operation managing apparatus 11A, refrigerating machines 12H to 12J (hereinafter, may be collectively referred to as "refrigerating machines 12"), and showcases 13*a* to 13*i* (hereinafter, may be collectively referred to as "showcases 13") serving as cooling/heating devices. Furthermore, in the store 10A, in addition to the refrigerating machines 12 and the showcases 13 which are described above, although not illustrated, indoor units and outdoor units for air conditioners, and devices that consume power, such as illumination devices and heating cooking devices, are installed.

The operation managing apparatus 11A, the refrigerating machines 12, and the showcases 13 are connected using a signal line 15. The operation managing apparatus 11A transmits control signals to the refrigerating machines 12 and the showcases 13 via the signal line 15 to perform various types of control such as defrosting of the showcases 13.

Figure 13:
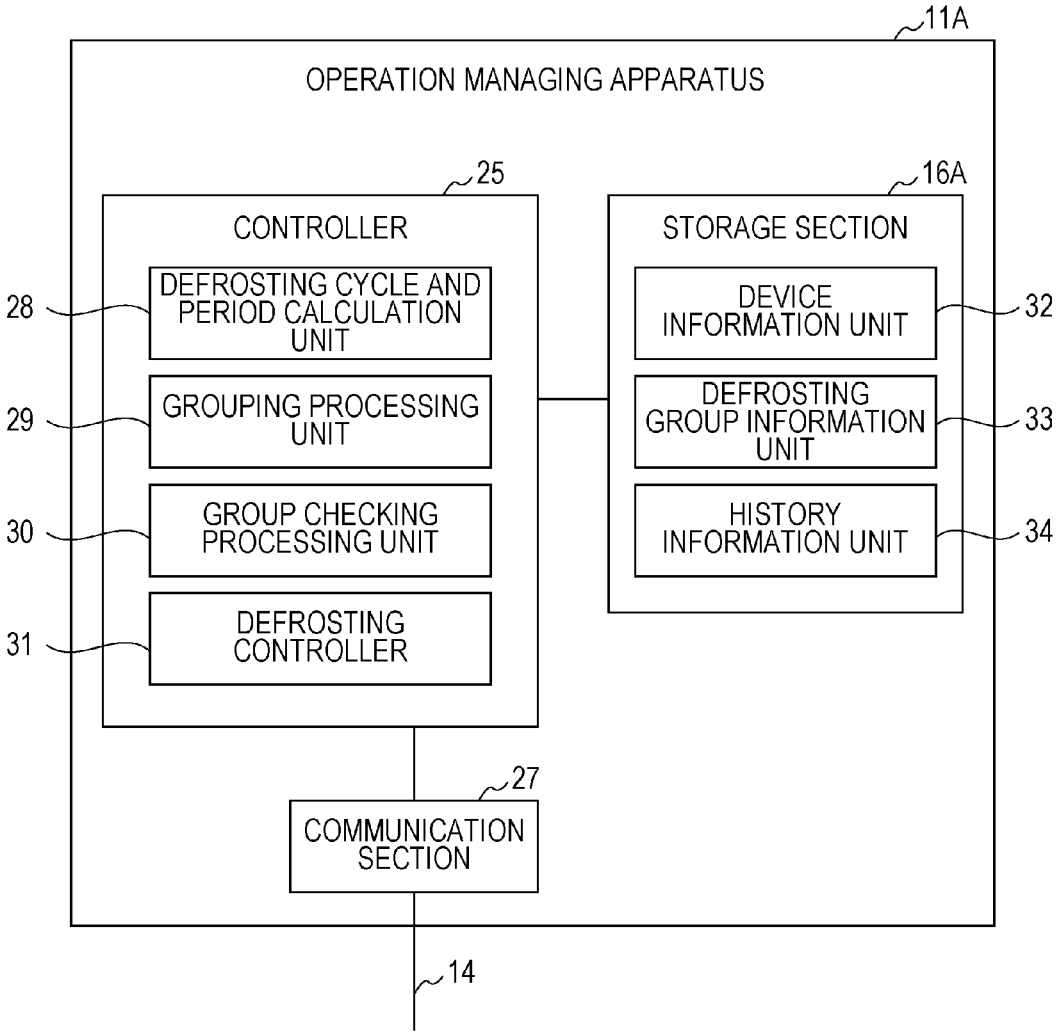
FIG. 13 is a diagram illustrating a configuration of an apparatus for managing operation of refrigerating machines according to the second embodiment.

The operation managing apparatus 11A performs, for example, for each indoor unit, the following: management of a time at which a shift signal for a temperature set value is output for the nighttime; management of, for air conditioning, an operation start time, a temperature set value, and outputting of a signal for switching between heating and cooling; and management of a lightning time for illumination. In addition, the operation managing apparatus 11A performs management of a defrosting period (cycle). Additionally, the operation managing apparatus 11A detects the power consumption of the entire store, and, for example, changes the defrosting period and outputs a shift signal for a temperature set value of an air conditioner. FIG. 13 is a diagram illustrating a configuration of the operation managing apparatus 11A according to some embodiments. In the preferred embodiments, the operation managing apparatus 11A illustrated in FIG. 13 includes a controller 25, a storage section 16, and a communication section 27.

In the preferred embodiments, the controller 25 has, e.g., a central processing unit (CPU) or processor that is configured to control various types of functions of the operation managing apparatus 11A. In the preferred embodiments, the controller 25 includes a defrosting cycle and period calculation unit 28, a grouping processing unit 29, a group checking processing unit 30, and a defrosting controller 31.

The storage section 16 stores various types of information items used for, for example, control performed in the operation managing apparatus 11A. The storage section 16 includes a device information unit 32 serving as a storage region, a defrosting group information unit 33, and a history information unit 34.

The communication section 27 is connected to the signal line 15. Under control performed by the controller 25, the communication section 27 transmits, via the signal line 15, control signals to the refrigerating machines 12 and the showcases 13, or receives various types of signals from the refrigerating machines 12 and the showcases 13.

Next, an operation of the operation managing apparatus 11A, more specifically, an operation of setting a plurality of groups (defrosting groups) that are sets of showcases whose defrosting periods are the same and whose defrosting cycles are the same in a case of defrosting the showcases 13, will be described.

A grouping operation performed by the operation managing apparatus 11A on the basis of the defrosting cycles and the defrosting periods will be described. The defrosting cycle and period calculation unit 28 included in the controller 25 acquires device information items stored in the device information unit 32 included in the storage section 16. Each of the device information items is prepared for a corresponding one of the showcases 13. In some embodiments, the device information items include, for example, the following various types of information items: an identification (ID), a power consumption during the pull-down operation, and a temperature set value of the corresponding showcase; an ID of the refrigerating machine connected to the corresponding showcase; ambient temperature and humidity of the corresponding showcase; products (e.g., vegetables, fish, meat, and so forth) displayed in the corresponding showcase; and an installation location.

The defrosting cycle and period calculation unit 28 calculates, on the basis of each of the acquired device information items, a defrosting cycle and a defrosting period, which is a time period taken to perform defrosting once, of the showcase 13 corresponding to the acquired device information item. For example, regarding each of the device information items, when the temperature set value included in the device information item is lower, the defrosting cycle and period calculation unit 28 sets the defrosting cycle to be shorter, and sets the defrosting period to be longer. Note that each of the device information items may include the defrosting cycle and defrosting period of a corresponding one of the showcases. In this case, the defrosting cycle and period calculation unit 28 acquires the defrosting cycle and defrosting period of each of the showcases without performing any process.

The grouping processing unit 29 included in the controller 25 performs a grouping process of grouping the showcases whose defrosting cycles are the same and whose defrosting periods are the same into one group.

Note that not only the grouping processing unit 29 groups only the showcases whose defrosting cycles are the same and whose defrosting periods are the same into one group, but also the grouping processing unit 29 may group the showcases whose defrosting cycles are in a predetermined range and whose defrosting periods are in a predetermined range into one group, assuming that the defrosting cycles in the predetermined range are the same defrosting cycle and the defrosting periods in the predetermined range are the same defrosting period.

After the grouping process based on the defrosting cycles and the defrosting periods is performed, the grouping processing unit 29 generates a defrosting group information item in which an ID of each of the groups that have been set, and IDs, the defrosting cycles, and the defrosting periods of the showcases belonging to the group are associated with one another. Furthermore, the grouping processing unit 29 causes the defrosting group information unit 33 included in the storage section 16 to store the defrosting group information item.

After that, the group checking processing unit 30 included in the controller 25 acquires, from the device information items, for each of the set groups, power consumptions, during the pull-down operation, of the showcases belonging to the group. Next, the group checking processing unit 30 calculates, for each of the groups, a total value of the power consumptions, during the pull-down operation, of the showcases belonging to the group. Each of the calculated total values of the power consumptions during the pull-down operation is a total value of the power consumptions, during the pull-down operation, of the showcases belonging to a corresponding one of the groups.

Next, a first grouping operation based on the power consumption of the entire store will be described. First, the above-described grouping process is performed on the showcases. In this case, the controller 25 generates a defrosting schedule information item on the basis of the defrosting cycles and the defrosting periods corresponding to the individual groups so that defrosting time slots corresponding to the individual groups do not coincide with each other.

The group checking processing unit 30 acquires a time slot (peak-power-consumption time slot) in which the power consumption of the entire store reaches a peak. A history information item indicating changes in the power consumption of the entire store over time for the past time periods is stored in the history information unit 34 included in the storage section 16. The group checking processing unit 30 can determine the peak-power-consumption time slot on the basis of the history information item.

The group checking processing unit 30 determines, on the basis of the determined peak-power-consumption time slot and the defrosting schedule information item, whether or not the pull-down operation is performed in the peak-power-consumption time slot. Note that the pull-down operation refers to a recovery operation which is performed at the last stage of defrosting in order to cool again the inside of a showcase whose temperature has increased. The power consumption during the pull-down operation is higher than that during a normal operation.

When the pull-down operation is performed in the peak-power-consumption time slot, the group checking processing unit 30 extracts the power consumptions during the pull-down operation from the device information items concerning the individual showcases belonging to the group for which the pull-down operation is performed in the peak-power-consumption time slot. Moreover, the group checking processing unit 30 calculates a total value (peak group power consumption) of the extracted power consumptions during the pull-down operation.

The group checking processing unit 30 acquires a power consumption of the entire store for the peak-power-consumption time slot on the basis of the history information item.

Furthermore, the group checking processing unit 30 acquires power consumptions of the entire store for defrosting time slots before and after the peak-power-consumption time slot on the basis of the history information item.

Additionally, the group checking processing unit 30 causes all or some of the showcases belonging to the group for which the pull-down operation is performed in the peak-power-consumption time slot to belong to both or either of the groups corresponding to the defrosting time slots before and after the peak-power-consumption time slot.

After that, the group checking processing unit 30 generates a defrosting group information item in accordance with changes in the groups to which the showcases belong. Furthermore, the group checking processing unit 30 causes the defrosting group information unit 33 to store the generated defrosting group information item. Then, after defrosting control performed for each of the changed groups is completed, the group configuration returns to the group configuration that was used before the groups have been changed.

Figure 14:
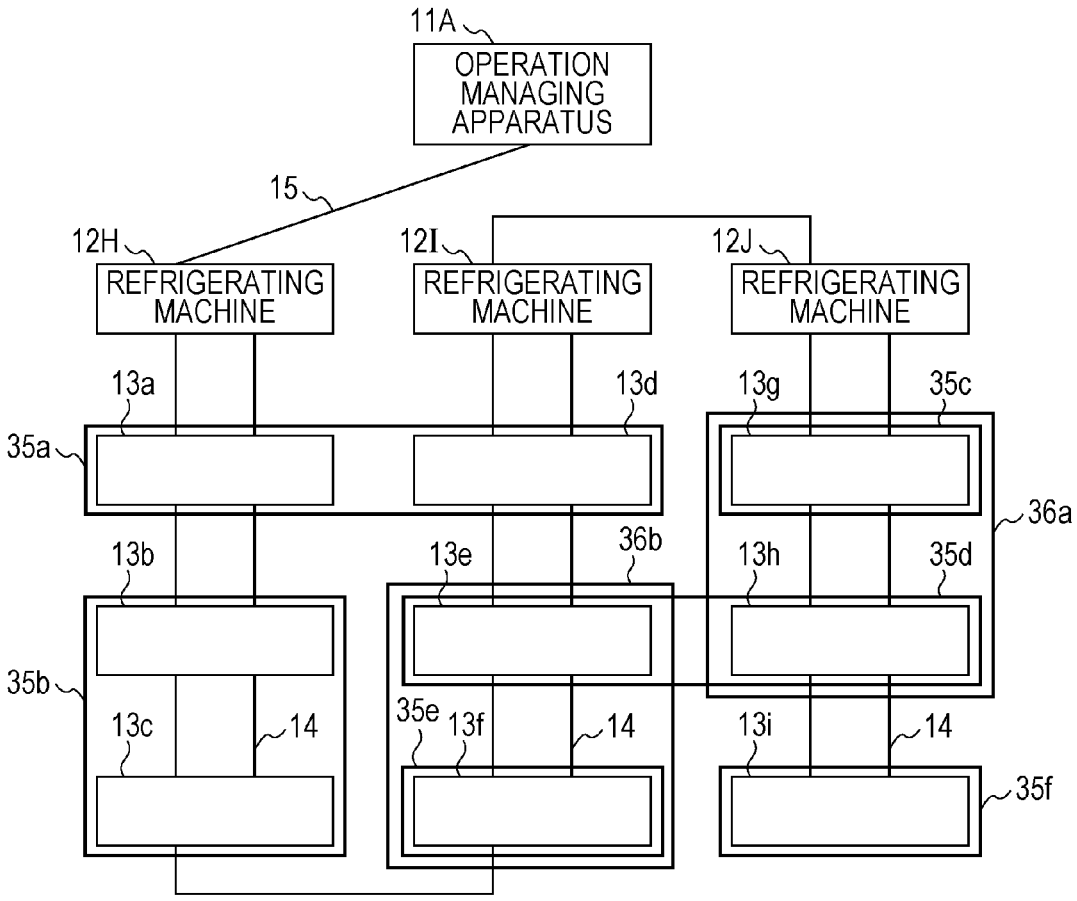
FIG. 14 is a diagram illustrating an example of a grouping operation based on the power consumption of the entire store in the second embodiment.
Figure 15A:
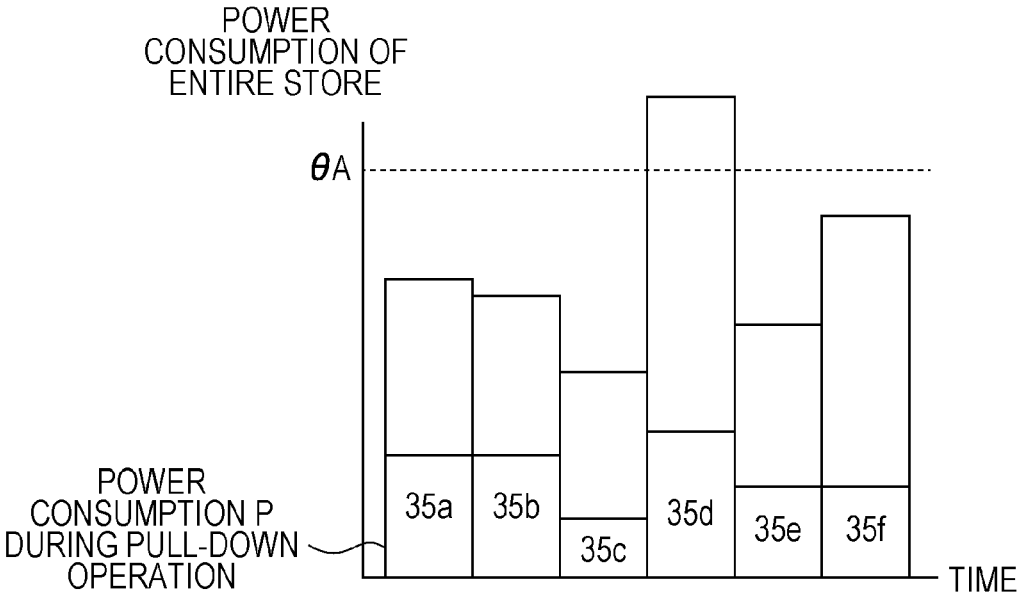
FIGS. 15A and 15B are graphs illustrating a first example of changes in the power consumption of the entire store over time in the second embodiment.
Figure 15B:
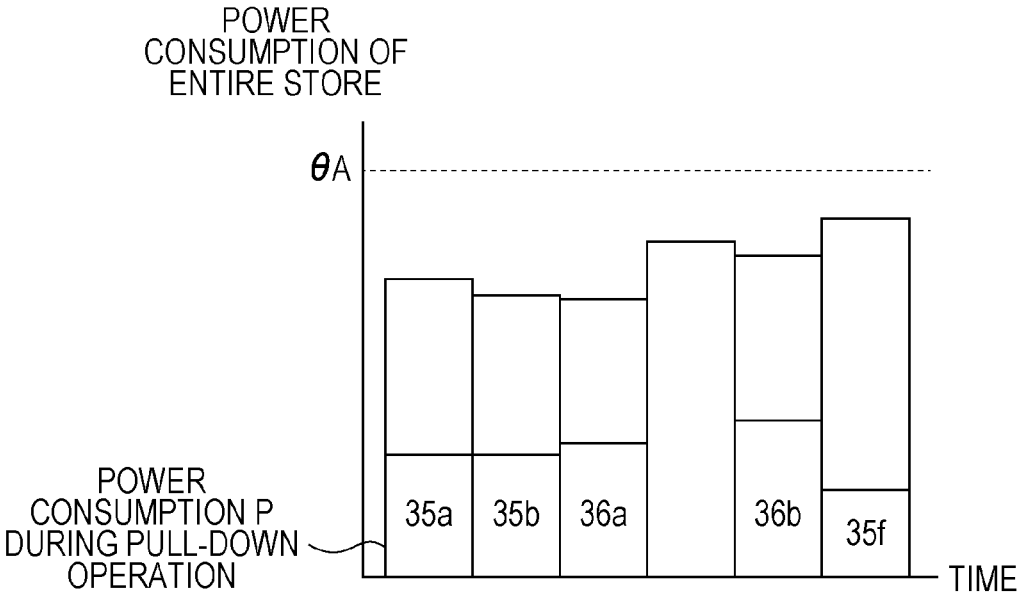

FIG. 14 is a diagram showing an illustrative example of the first grouping operation based on the power consumption of the entire store. Furthermore, FIGS. 15A and 15B are illustrative graphs showing a first example of changes in the power consumption of the entire store over time. In FIG. 14, at first, groups 35*a* to 35*f* are set. As illustrated in FIG. 15A, the pull-down operation is performed in the peak-power-consumption time slot for the group 35*d* among the groups 35*a* to 35*f*.

In this case, as illustrated in FIG. 14, together with the showcase 13*g* belonging to the group 35*c*, the showcase 13*h* belonging to the group 35*d* belongs to a new group 36*a* having a defrosting time slot that is the same as the defrosting time slot of the group 35*c*. Furthermore, together with the showcase 13*f* belonging to the group 35*e*, the showcase 13*e* belonging to the group 35*d* belongs to a new group 36*b* having a defrosting time slot that is the same as the defrosting time slot of the group 35*e*. As a result, the power consumption of the entire store changes over time as illustrated in FIG. 15B. Accordingly, the power consumption of the entire store in the peak-power-consumption time slot is reduced, so that a risk of exceeding the contracted amount θA of electric power can be prevented.

Next, an illustrative second grouping operation based on the power consumption of the entire store will be described. First, as in the first grouping operation described above, the grouping process is performed on the showcases. In this case, the controller 25 generates a defrosting schedule information item on the basis of the defrosting cycles and the defrosting periods corresponding to the individual groups so that the defrosting time slots corresponding to the individual groups do not coincide with each other.

The group checking processing unit 30 acquires a time slot (peak-power-consumption time slot) in which the power consumption of the entire store reaches a peak. The history information item indicating changes in the power consumption of the entire store over time for the past time periods is stored in the history information unit 34 included in the storage section 16. The group checking processing unit 30 can determine the peak-power-consumption time slot on the basis of the history information item.

Furthermore, the group checking processing unit 30 extracts the power consumptions during the pull-down operation from the device information items concerning the individual showcases belonging to the group for which the pull-down operation is performed in the peak-power-consumption time slot. Moreover, the group checking processing unit 30 calculates a total value (peak group power consumption) of the extracted power consumptions during the pull-down operation.

Furthermore, the group checking processing unit 30 acquires a power consumption of the entire store for the peak-power-consumption time slot on the basis of the history information item.

Furthermore, on the basis of the history information item, the group checking processing unit 30 calculates total values (off-peak group power consumptions) of the power consumptions, during the pull-down operation, of the showcases belonging to the groups in which the pull-down operation is performed in predetermined time slots before and after the peak-power-consumption time slot.

Moreover, the group checking processing unit 30 determines whether or not an off-peak group power consumption that is lower than the peak group power consumption exists.

When an off-peak group power consumption that is lower than the peak group power consumption exists, the group checking processing unit 30 swaps the defrosting time slot corresponding to the group corresponding to the peak group power consumption and the defrosting time slot corresponding to the group corresponding to the minimum off-peak group power consumption.

After that, the group checking processing unit 30 generates a defrosting group information item in accordance with swapping of the groups. Furthermore, the group checking processing unit 30 causes the defrosting group information unit 33 to store the generated defrosting group information item. Then, after defrosting control performed for each of the swapped groups is completed, the group configuration returns to the group configuration that was used before the groups have been swapped.

Figure 16A:
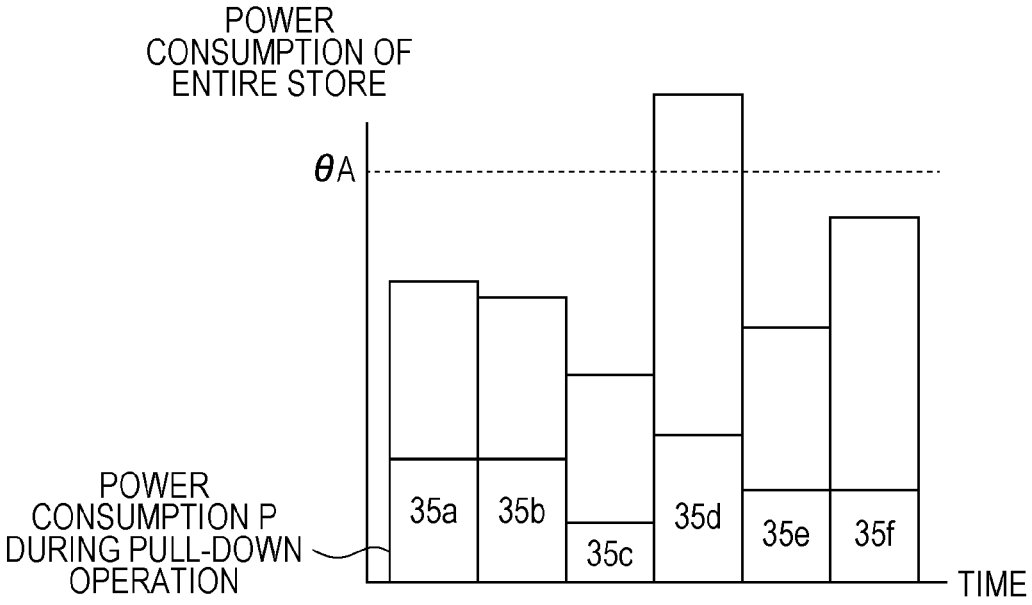
FIGS. 16A and 16B are graphs illustrating a second example of changes in the power consumption of the entire store over time in the second embodiment.
Figure 16B:
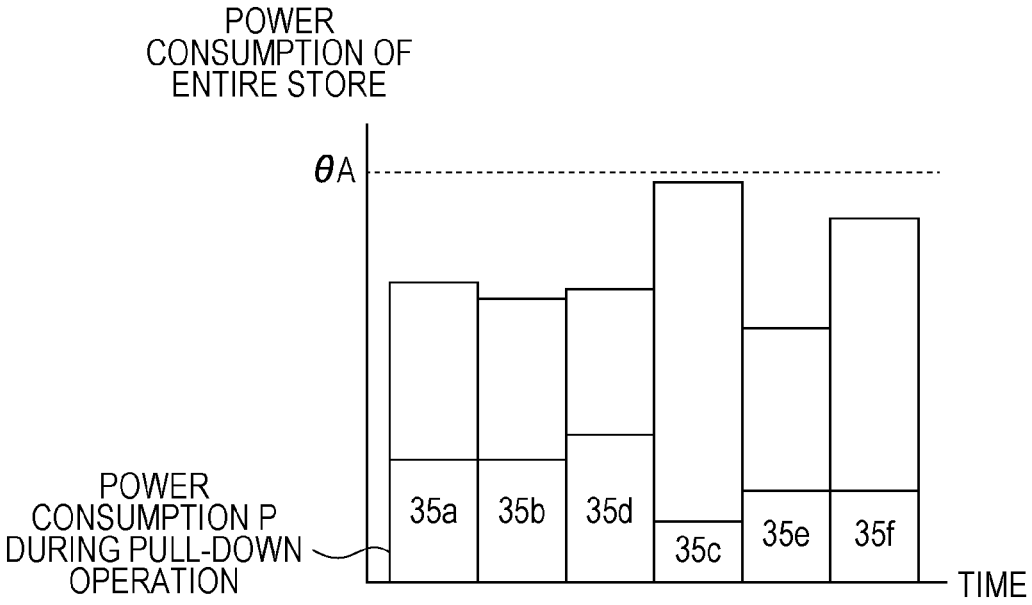

FIGS. 16A and 16B are illustrative graphs showing a second example of changes in the power consumption of the entire store over time. In FIG. 16A, the power consumption of the group 35*c* is lower than the power consumption of the group 35*d* for which the pull-down operation is performed in the peak-power-consumption time slot, and is the minimum power consumption. In this case, as illustrated in FIG. 16B, the defrosting time slot corresponding to the group 35*c* and the defrosting time slot corresponding to the group 35*d* are swapped. Accordingly, the power consumption of the entire store for the peak-power-consumption time slot is reduced, so that a risk of exceeding the contracted amount θA of electric power can be prevented.

After the grouping process is performed on the showcases in the above-described procedure, the defrosting controller 31 included in the controller 25 performs, on the basis of the defrosting group information item stored in the defrosting group information unit 33 included in the storage section 16, for each of the groups, defrosting control on the showcases belonging to the group. The times at which defrosting control is performed for the individual groups are different from one another.

In the foregoing second embodiment, the operation managing apparatus 11A performs all of the grouping process based on the power consumptions of the showcases, the grouping process based on the states of connection between the showcases and the refrigerating machines, the grouping process based on the total value of the defrosting periods for each of the groups, and the grouping process based on the power consumption of the entire store. The above-described grouping processes may be appropriately selected, and performed. Furthermore, the order in which the above-described grouping processes are performed may be appropriately changed.

BROAD SCOPE OF THE INVENTION

While the present invention has been particularly shown and described with reference to certain exemplary embodiments thereof, it will be understood by those of ordinary skill in the art that various changes in form and detail may be made therein without departing from the spirit and scope of the present invention as defined by the appended claims.

What is claimed is:

1. An apparatus for managing operation of refrigerating machines by controlling defrosting of an evaporator for each of a plurality of refrigeration cycles, each of the plurality of refrigeration cycles using at least a compressor, a condenser, a decompressor and the evaporator and being for a corresponding one of cooling/heating devices which are installed in a single store, each of the cooling/heating devices being configured to be capable of a cooling target to be cooled by utilizing an effect of heat absorption due to evaporation of a refrigerant in the evaporator, comprising:

a storage section that stores, for each of the plurality of refrigeration cycles, a defrosting start time or defrosting end time and a power consumption during a pull-down operation, the power consumption during the pull-down operation being a power consumption which is necessary for the pull-down operation performed for a corresponding one of the cooling/heating devices after defrosting is performed;

a power consumption estimating section that estimates a power consumption of the store for each of predetermined time periods, the power consumption of the store including at least the power consumptions of the plurality of refrigeration cycles; and a defrosting shift controller that changes the defrosting start time or defrosting end time so that a total estimated power consumption does not exceed an upper limit value of a power consumption when the pull-down operation is performed, the total estimated power consumption being obtained by adding the power consumption during the pull-down operation stored in the storage section to the power consumption estimated by the power consumption estimating section, the upper limit value of the power consumption being set in advance in the store;

wherein, when the total estimated power consumption exceeds the upper limit value of the power consumption that is set in advance in the store, the defrosting shift controller swaps, among the plurality of refrigeration cycles, the defrosting start time or defrosting end time of one refrigeration cycle and the defrosting start time or defrosting end time of another refrigeration cycle.

2. The apparatus for managing operation of refrigerating machines according to claim 1, wherein, for a power consumption of the store for a day, the storage section divides 24 hours into 30-minute time periods, evaluates the integral of electric power consumed by the store for each of the 30-minute time periods over an interval of 30 minutes to obtain a value, and stores the value as a past power consumption.

3. The apparatus for managing operation of refrigerating machines according to claim 1, wherein the storage section stores a room temperature or outside air temperature of the store and a power consumption for each of the predetermined time periods, the power consumption for the predetermined time period corresponding to a change in the room temperature or outside air temperature, and wherein the power consumption estimating section estimates the total estimated power consumption for each of the predetermined time periods on the basis of a measured room temperature or outside air temperature of the store and a change in the measured room temperature or outside air temperature and on the basis of the room temperature or outside air temperature of the store and the power consumption for the predetermined time period which are stored in the storage section, the power consumption for the predetermined time period corresponding to the change in the room temperature or outside air temperature.

4. The apparatus for managing operation of refrigerating machines according to claim 1, wherein the storage section stores a weather condition and a power consumption for each of the predetermined time periods, the power consumption for the predetermined time period corresponding to a change in the weather condition, and wherein the power consumption estimating section estimates the total estimated power consumption for each of the predetermined time periods on the basis of an observed weather condition and a change in the observed weather condition and on the basis of the weather condition and the power consumption for the predetermined time period which are stored in the storage section, the power consumption for the predetermined time period corresponding to the change in the weather condition.

5. The apparatus for managing operation of refrigerating machines according to claim 1, wherein the storage section stores power consumptions for each of the predetermined time periods for the past year with respect to a time when the total estimated power consumption was most recently estimated.

6. The apparatus for managing operation of refrigerating machines according to claim 1, wherein the storage section stores power consumptions for each of the predetermined time periods for at least the past ten days with respect to a time when the power consumption was most recently estimated, and the power consumption estimating section estimates the total estimated power consumption for each of the predetermined time periods with reference to an average value of the power consumptions for the predetermined time period for at least the past ten days.

7. The apparatus for managing operation of refrigerating machines according to claim 1, wherein the power consumption estimating section estimates the total estimated power consumption for each of the predetermined time periods for at least the following three hours with respect to a time when the power consumption was most recently estimated.

8. The apparatus for managing operation of refrigerating machines according to claim 1, wherein estimation of the total estimated power consumption by the power consumption estimating section is performed every hour with respect to a time when the total estimated power consumption was most recently estimated.

9. The apparatus for managing operation of refrigerating machines according to claim 1, wherein the defrosting shift controller includes a calculation unit that acquires device information concerning each of the cooling/heating devices, and that calculates a defrosting period and a defrosting cycle of the cooling/heating device on the basis of the device information concerning the cooling/heating device, a group setting unit that sets a plurality of groups on the basis of the defrosting periods and the defrosting cycles which have been calculated by the calculation unit, each of the plurality of groups being a set of the cooling/heating devices whose defrosting periods are the same and whose defrosting cycles are the same, a group information storage unit that stores group information including at least power consumptions associated with the plurality of groups which have been set by the group setting unit, and a defrosting controller that, on the basis of the power consumptions included in the group information stored in the group information storage unit, determines an order for each of the plurality of groups, and that performs defrosting control on the cooling/heating devices belonging to the group.

10. The apparatus for managing operation of refrigerating machines according to claim 9, wherein the defrosting shift controller further includes a first group resetting unit that, when a total value of the power consumptions, during the pull-down operation, of the cooling/heating devices belonging to one group among the plurality of groups is equal to or higher than the upper limit value of the power consumption that is set in advance in the store, divides the one group so as to set a new group.

11. The apparatus for managing operation of refrigerating machines according to claim 10, wherein the defrosting shift controller further includes a second group resetting unit that, when all of the cooling/heating devices connected via a refrigerant pipe to one refrigerating machine belong to only one group among the plurality of groups, divides the one group so as to set a new group.

12. The apparatus for managing operation of refrigerating machines according to claim 11, wherein the defrosting shift controller further includes a third group resetting unit that, when defrosting of all of the cooling/heating devices has not been completed within a predetermined time period, combines at least two groups among the plurality of groups together so as to set a new group.

13. The apparatus for managing operation of refrigerating machines according to claim 12, wherein the defrosting shift controller further includes a fourth group resetting unit that causes, among the plurality of groups, at least some of the cooling/heating devices belonging to a group corresponding to a time slot in which a total value of a power consumption of a device other than the cooling/heating devices and the power consumptions of the cooling/heating devices in the store in which the cooling/heating devices are installed becomes a maximum, to belong to another group, and that swaps, among the plurality of groups, a time slot corresponding to a group corresponding to the time slot in which a total value of a power consumption of a device other than the cooling/heating devices and the power consumptions of the cooling/heating devices in the store in which the cooling/heating devices are installed becomes a maximum and a time slot corresponding to another group.

14. The apparatus for managing operation of refrigerating machines according to claim 1, wherein said apparatus includes a controller having a processor configured to perform functions of the apparatus for managing operation of refrigerator machines.

15. A system for managing operation of refrigerating machines by controlling defrosting of an evaporator for each of a plurality of refrigeration cycles, each of the plurality of refrigeration cycles using at least a compressor, a condenser, a decompressor and the evaporator and being for a corresponding one of cooling/heating devices which are installed in a single store, each of the cooling/heating devices being configured to be capable of a cooling target to be cooled by utilizing an effect of heat absorption due to evaporation of a refrigerant in the evaporator, comprising:

an operation managing apparatus having a controller with a processor, data storage and a communications section;

said data storage including a storage section that stores, for each of the plurality of refrigeration cycles, a defrosting start time or defrosting end time and a power consumption during a pull-down operation, the power consumption during the pull-down operation being a power consumption which is necessary for the pull-down operation performed for a corresponding one of the cooling/heating devices after defrosting is performed;

said processor being configured with a power consumption estimating function that estimates a power consumption of the store for each of predetermined time periods, the power consumption of the store including at least the power consumptions of the plurality of refrigeration cycles; and said processor being configured with a defrosting shift function that changes the defrosting start time or defrosting end time so that a total estimated power consumption does not exceed an upper limit value of a power consumption when the pull-down operation is performed, the total estimated power consumption being obtained by adding the power consumption during the pull-down operation stored in the storage section to the power consumption estimated by the power consumption estimating section, the upper limit value of the power consumption being set in advance in the store;

wherein, when the total estimated power consumption exceeds the upper limit value of the power consumption that is set in advance in the store, the defrosting shift function swaps, among the plurality of refrigeration cycles, the defrosting start time or defrosting end time of one refrigeration cycle and the defrosting start time or defrosting end time of another refrigeration cycle.

16. The system for managing operation of refrigerating machines according to claim 15, wherein said operation managing apparatus manages operations of a plurality of refrigerating machines employing communications signals transmitted to each of said plurality of individual refrigerating machines via said communications section.

* * * * *